US009097157B2

(12) United States Patent
Umemoto et al.

(10) Patent No.: US 9,097,157 B2
(45) Date of Patent: Aug. 4, 2015

(54) EXHAUST PURIFICATION SYSTEM OF INTERNAL COMBUSTION ENGINE

(75) Inventors: Kazuhiro Umemoto, Ebina (JP); Mikio Inoue, Numazu (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 193 days.

(21) Appl. No.: 13/582,909

(22) PCT Filed: Nov. 9, 2011

(86) PCT No.: PCT/JP2011/075849

§ 371 (c)(1),
(2), (4) Date: Sep. 5, 2012

(87) PCT Pub. No.: WO2013/069115

PCT Pub. Date: May 16, 2013

(65) Prior Publication Data

US 2013/0115145 A1 May 9, 2013

(51) Int. Cl.
*B01D 50/00* (2006.01)
*F01N 3/08* (2006.01)
(Continued)

(52) U.S. Cl.
CPC ..... *F01N 3/0814* (2013.01); *F01N 3/0821* (2013.01); *F01N 3/0842* (2013.01);
(Continued)

(58) Field of Classification Search
CPC ..... F01N 3/0814; F01N 3/0842; F01N 3/022; F01N 2330/06
USPC ..... 422/171, 177, 180; 60/295, 297, 301; 55/523
See application file for complete search history.

(56) References Cited

U.S. PATENT DOCUMENTS 5,052,178 A 10/1991 Clerc et al.
5,057,483 A 10/1991 Wan
(Continued)

FOREIGN PATENT DOCUMENTS

CN 101454081 A 6/2009
CN 101600860 A 12/2009
(Continued)

OTHER PUBLICATIONS

U.S. Appl. No. 13/578,148, filed Aug. 9, 2012, in the name of Kazuhiro Umemoto et al.
(Continued)

*Primary Examiner* — Tom P Duong
(74) *Attorney, Agent, or Firm* — Oliff PLC

(57) ABSTRACT

An exhaust purification system of an internal combustion engine is provided with an exhaust purification catalyst which includes an upstream side catalyst and a downstream side catalyst and removes $NO_X$. The upstream side catalyst has an oxidation ability, while the downstream side catalyst has catalyst particles of precious metals and basic exhaust flow surface parts. The system makes the concentration of hydrocarbons which flow into the exhaust purification catalyst vibrate by within a predetermined range of amplitude and by within a predetermined range of period and reduces the $NO_X$. The upstream side catalyst includes an upstream side substrate and an upstream side container, while the downstream side catalyst includes a downstream side substrate, a downstream side container, and a channel of exhaust between the downstream side substrate and the downstream side container.

8 Claims, 15 Drawing Sheets

(51) Int. Cl.
*F01N 3/10* (2006.01)
*F01N 3/36* (2006.01)
*F01N 13/00* (2010.01)

(52) U.S. Cl.
CPC ..... *F01N3/0871* (2013.01); *F01N 3/103* (2013.01); *F01N 3/36* (2013.01); *F01N 13/009* (2014.06); *F01N 2260/06* (2013.01); *F01N 2470/18* (2013.01); *F01N 2510/06* (2013.01); *F01N 2610/03* (2013.01)

(56) References Cited

U.S. PATENT DOCUMENTS 5,075,274 A 12/1991 Kiyohide et al.
5,402,641 A 4/1995 Katoh et al.
5,882,607 A 3/1999 Miyadera et al.
6,109,024 A 8/2000 Kinugasa et al.
6,327,851 B1 12/2001 Bouchez et al.
6,413,483 B1 7/2002 Brisley et al.
6,477,834 B1 11/2002 Asanuma et al.
6,667,018 B2 12/2003 Noda et al.
6,813,882 B2 11/2004 Hepburn et al.
6,854,264 B2 2/2005 Elwart et al.
6,877,311 B2 4/2005 Uchida
6,983,589 B2 1/2006 Lewis et al.
7,063,642 B1 6/2006 Hu et al.
7,073,325 B2 7/2006 Nakatani et al.
7,082,753 B2 8/2006 Dalla Betta et al.
7,111,456 B2 9/2006 Yoshida et al.
7,137,379 B2 11/2006 Sasaki et al.
7,146,800 B2 12/2006 Toshioka et al.
7,165,393 B2 1/2007 Betta et al.
7,299,625 B2 11/2007 Uchida et al.
7,332,135 B2 2/2008 Gandhi et al.
7,412,823 B2 8/2008 Reuter et al.
7,454,900 B2 11/2008 Hayashi
7,484,504 B2 2/2009 Kato et al.
7,506,502 B2 3/2009 Nakano et al.
7,549,284 B2 6/2009 Iihoshi et al.
7,703,275 B2 4/2010 Asanuma et al.
7,707,821 B1 5/2010 Legare
7,861,516 B2 1/2011 Allansson et al.
8,099,950 B2 1/2012 Kojima et al.
8,215,101 B2 7/2012 Tsujimoto et al.
8,261,532 B2 9/2012 Fukuda et al.
8,281,569 B2 10/2012 Handa et al.
8,434,296 B2 5/2013 Wada et al.
8,572,950 B2 11/2013 Bisaiji et al.
8,656,706 B2 2/2014 Umemoto et al.
8,671,667 B2 3/2014 Bisaiji et al.
8,679,410 B2 3/2014 Umemoto et al.
8,689,543 B2 4/2014 Numata et al.
8,695,325 B2 4/2014 Bisaiji et al.
2001/0052232 A1 12/2001 Hoffmann et al.
2002/0029564 A1 3/2002 Roth et al.
2002/0053202 A1 5/2002 Akama et al.
2003/0010020 A1 1/2003 Taga et al.
2003/0040432 A1 2/2003 Beall et al.
2003/0101713 A1 6/2003 Betta et al.
2004/0045285 A1 3/2004 Penetrante et al.
2004/0050037 A1 3/2004 Betta et al.
2004/0055285 A1 3/2004 Rohr et al.
2004/0154288 A1 8/2004 Okada et al.
2004/0175305 A1 9/2004 Nakanishi et al.
2004/0187477 A1 9/2004 Okugawa et al.
2005/0135977 A1 6/2005 Park et al.
2005/0147541 A1* 7/2005 Ajisaka et al. ..... 422/177
2006/0053778 A1* 3/2006 Asanuma et al. ..... 60/295
2006/0107657 A1 5/2006 Bernler et al.
2006/0153761 A1 7/2006 Bandl-Konrad et al.
2006/0286012 A1 12/2006 Socha et al.
2007/0016357 A1 1/2007 Nakagawa et al.
2007/0028601 A1 2/2007 Duvinage et al.
2007/0059223 A1 3/2007 Golunski et al.
2007/0089403 A1 4/2007 Pfeifer et al.
2007/0125073 A1 6/2007 Reuter
2007/0151232 A1 7/2007 Dalla Betta et al.
2008/0022662 A1 1/2008 Yan
2008/0053073 A1 3/2008 Kalyanaraman et al.
2008/0102010 A1 5/2008 Bruck et al.
2008/0120963 A1 5/2008 Morita et al.
2008/0148711 A1 6/2008 Takubo
2008/0154476 A1 6/2008 Takubo
2008/0196398 A1 8/2008 Yan
2008/0223020 A1 9/2008 Yoshida et al.
2008/0276602 A1 11/2008 McCabe et al.
2009/0000277 A1 1/2009 Yoshida et al.
2009/0049824 A1 2/2009 Kojima et al.
2009/0049825 A1 2/2009 Ohashi
2009/0049826 A1 2/2009 Toshioka et al.
2009/0077948 A1 3/2009 Mondori et al.
2009/0084091 A1 4/2009 Tsujimoto et al.
2009/0118121 A1 5/2009 Sarai
2009/0120072 A1 5/2009 Dalla Betta et al.
2009/0151332 A1 6/2009 Toshioka et al.
2009/0191108 A1 7/2009 Blanchard et al.
2009/0196811 A1 8/2009 Yamashita et al.
2009/0229251 A1 9/2009 Kadowaki
2009/0249768 A1 10/2009 Asanuma et al.
2009/0266057 A1 10/2009 Tsujimoto et al.
2009/0282809 A1 11/2009 Toshioka
2009/0288393 A1 11/2009 Matsuno et al.
2009/0313970 A1 12/2009 Iida
2010/0005873 A1 1/2010 Katoh et al.
2010/0055012 A1 3/2010 Grisstede et al.
2010/0107613 A1 5/2010 Masuda et al.
2010/0115923 A1 5/2010 Tsujimoto et al.
2010/0126148 A1 5/2010 Morishima et al.
2010/0132356 A1 6/2010 Lee
2010/0154387 A1 6/2010 Shibata et al.
2010/0233051 A1 9/2010 Grisstede et al.
2010/0236224 A1 9/2010 Kumar et al.
2010/0242459 A1 9/2010 Tsujimoto et al.
2011/0041486 A1 2/2011 Kato et al.
2011/0047984 A1 3/2011 Lee et al.
2011/0047988 A1 3/2011 Lewis et al.
2011/0113754 A1 5/2011 Kohara et al.
2011/0120100 A1 5/2011 Yin et al.
2011/0131952 A1 6/2011 Onodera et al.
2011/0173950 A1 7/2011 Wan et al.
2011/0209459 A1 9/2011 Hancu et al.
2012/0122660 A1 5/2012 Andersen et al.
2012/0124967 A1 5/2012 Yang et al.
2012/0124971 A1 5/2012 Bisaiji et al.
2012/0131908 A1 5/2012 Bisaiji et al.
2013/0000284 A1 1/2013 Bisaiji et al.
2013/0011302 A1 1/2013 Bisaiji et al.
2013/0022512 A1 1/2013 Bisaiji et al.

FOREIGN PATENT DOCUMENTS

EP 1 033 479 A2 9/2000
EP 1 273 337 A1 1/2003
EP 1 371 415 A1 12/2003
EP 1 519 015 A2 3/2005
EP 1544429 A1 6/2005
EP 1 710 407 A1 10/2006
EP 1 793 099 A1 6/2007
EP 1 911 506 A1 4/2008
EP 1 936 164 A1 6/2008
EP 1 965 048 A1 9/2008
EP 2 063 078 A1 5/2009
EP 2 149 684 A1 2/2010
EP 2 239 432 10/2010
EP 2 460 989 A1 6/2012
JP A-04-200637 7/1992
JP A-H08-117601 5/1996
JP A-09-004437 1/1997
JP A-09-220440 8/1997
JP A-11-30117 2/1999
JP A-11-062559 3/1999
JP A-11-081994 3/1999
JP A-2000-257419 9/2000
JP A-2002-188429 7/2002

(56) References Cited

FOREIGN PATENT DOCUMENTS

| | | |
|---|---|---|
| JP | A-2004-016850 | 1/2004 |
| JP | A-2004-36543 | 2/2004 |
| JP | A-2004-216224 | 8/2004 |
| JP | A-2004-290965 | 10/2004 |
| JP | A-2004-308526 | 11/2004 |
| JP | A-2004-316458 | 11/2004 |
| JP | A-2005-61340 | 3/2005 |
| JP | A-2005-113801 | 4/2005 |
| JP | A-2005-171853 | 6/2005 |
| JP | A-2005-177738 | 7/2005 |
| JP | A-2006-501390 | 1/2006 |
| JP | A-2006-512529 | 4/2006 |
| JP | A-2006-342700 | 12/2006 |
| JP | A-2007-064167 | 3/2007 |
| JP | A-2007-514090 | 5/2007 |
| JP | A-2007-514104 | 5/2007 |
| JP | A-2007-154794 | 6/2007 |
| JP | B2-3969450 | 9/2007 |
| JP | A-2007-278120 | 10/2007 |
| JP | A-2008-002451 | 1/2008 |
| JP | A-2008-19760 | 1/2008 |
| JP | A-2008-69769 | 3/2008 |
| JP | A-2008-231926 | 10/2008 |
| JP | A-2008-232003 | 10/2008 |
| JP | A-2008-255858 | 10/2008 |
| JP | A-2008-267178 | 11/2008 |
| JP | A-2008-267217 | 11/2008 |
| JP | A-2008-286186 | 11/2008 |
| JP | A-2008-543559 | 12/2008 |
| JP | A-2009-30560 | 2/2009 |
| JP | A-2009-112967 | 5/2009 |
| JP | A-2009-114879 | 5/2009 |
| JP | A-2009-156067 | 7/2009 |
| JP | A-2009-165922 | 7/2009 |
| JP | A-2009-167973 | 7/2009 |
| JP | A-2009-168031 | 7/2009 |
| JP | A-2009-191823 | 8/2009 |
| JP | A-2009-221939 | 10/2009 |
| JP | A-2009-226349 | 10/2009 |
| JP | A-2009-243362 | 10/2009 |
| JP | A-2009-275631 | 11/2009 |
| JP | A-2009-275666 | 11/2009 |
| JP | A-2010-012459 | 1/2010 |
| JP | A-2010-048134 | 3/2010 |
| JP | A-2011-190803 | 9/2011 |
| JP | B1-4868097 | 2/2012 |
| WO | WO 2005/059324 A1 | 6/2005 |
| WO | WO 2006/131825 | 12/2006 |
| WO | WO 2007/026229 | 3/2007 |
| WO | WO 2007/141638 | 12/2007 |
| WO | WO 2008/007810 | 1/2008 |
| WO | WO 2008/012653 | 1/2008 |
| WO | WO 2009/016822 | 2/2009 |
| WO | WO 2009/056958 | 5/2009 |
| WO | WO 2009/082035 | 7/2009 |
| WO | WO 2011/114499 | 9/2011 |
| WO | WO 2011/114501 | 9/2011 |
| WO | WO 2011/118044 | 9/2011 |

OTHER PUBLICATIONS

U.S. Appl. No. 13/581,186, filed Aug. 24, 2012, in the name of Kazuhiro Unemoto et al.
Jun. 16, 2014 Office Action issued in U.S. Appl. No. 13/581,186.
Aug. 13, 2013 International Preliminary Report on Patentability issued in International Patent Application No. PCT/JP2011/053429 (with translation).
Aug. 8, 2013 Office Action issued in U.S. Appl. No. 13/258,483.
Feb. 6, 2014 Corrected Notice of Allowability issued in U.S. Appl. No. 13/202,694.
Dec. 21, 2010 International Search Report issued in International Patent Application No. PCT/JP2010/065449 (with translation).
Dec. 27, 2011 International Search Report issued in International Patent Application No. PCT/JP2011/075618 (with translation).
Jun. 15, 2010 International Search Report issued in International Patent Application No. PCT/JP2010/054730 (with translation).
Nov. 22, 2010 International Search Report issued in International Patent Application No. PCT/JP2010/065186 (with translation).
Jan. 18, 2011 International Search Report issued in International Patent Application No. PCT/JP2010/067705.
Jan. 18, 2011 International Search Report issued in International Application No. PCT/JP2010/067707.
Jan. 18, 2011 International Search Report issued in International Patent Application No. PCT/JP2010/068785.
Jul. 14, 2014 Office Action issued in U.S. Appl. No. 13/262,001.
Jul. 14, 2014 Office Action issued in U.S. Appl. No. 13/264,884.
Jun. 19, 2014 Office Action issued in U.S. Appl. No. 13/264,594.
Jun. 21, 2011 International Search Report issued in International Patent Application No. PCT/JP2011/059880 (with translation).
Jun. 23, 2014 Office Action issued in U.S. Appl. No. 13/262,858.
Jun. 26, 2014 Office Action issued in U.S. Appl. No. 13/580,000.
Jun. 29, 2010 International Search Report issued in International Patent Application No. PCT/JP2010/055303 (with translation).
Mar. 15, 2011 International Search Report issued in International Patent Application No. PCT/JP2011/053429 (with translation).
Mar. 22, 2011 International Search Report issued in International Patent Application No. PCT/JP2010/073645 (with translation).
Mar. 22, 2011 International Search Report issued in International Patent Application No. PCT/JP2010/072299 (with translation).
Mar. 8, 2011 International Search Report issued in International Patent Application No. PCT/JP2011/052969 (with translation).
May 15, 2013 Office Action in U.S. Appl. No. 13/202,694.
May 17, 2011 International Search Report issued in International Patent Application No. PCT/JP2011/057264 (with translation).
May 2, 2014 Office Action issued in U.S. Appl. No. 13/263,660.
Mar. 28, 2014 Notice of Allowance issued in U.S. Appl. No. 13/582,862.
Mar. 4, 2014 Notice of Allowance issued in U.S. Appl. No. 13/255,786.
Nov. 13, 2013 Notice of Allowance issued in U.S. Appl. No. 13/202,692.
Oct. 17, 2013 Notice of Allowance issued in U.S. Appl. No. 13/202,694.
Nov. 22, 2010 International Search Report issued in International Patent Application No. PCT/JP2010/065187.
Nov. 26, 2012 Office Action issued in U.S. Appl. No. 13/202,694.
Oct. 26, 2010 International Search Report issued in International Patent Application No. PCT/JP2010/063135.
Oct. 26, 2012 Office Action issued in U.S. Appl. No. 13/202,692.
Oct. 23, 2013 Office Action issued in U.S. Appl. No. 13/263,272.
Apr. 23, 2014 Office Action issued in U.S. Appl. No. 13/260,986.
Apr. 3, 2014 Office Action issued in U.S. Appl. No. 13/259,574.
Dec. 20, 2013 Office Action issued in U.S. Appl. No. 13/264,230.
Jul. 1, 2014 Office Action issued in U.S. Appl. No. 13/257,789.
Jul. 24, 2013 Office Action issued in U.S. Appl. No. 13/202,692.
May 7, 2014 Office Action issued in U.S. Appl. No. 13/264,062.
May 8, 2014 Office Action issued in U.S. Appl. No. 13/375,674.
U.S. Appl. No. 13/202,692 in the name of Umemoto et al., filed Sep. 20, 2011.
U.S. Appl. No. 13/202,733 in the name of Bisaui et al., filed Sep. 30, 2011.
U.S. Appl. No. 13/257,789 in the name of Nishioka et al., filed Oct. 14, 2011.
U.S. Appl. No. 13/258,483 in the name of Numata et al., filed Sep. 22, 2011.
U.S. Appl. No. 13/259,574 in the name of Tsukamoto et al., filed Sep. 23, 2011.
U.S. Appl. No. 13/259,885 in the name of Umemoto et al., filed Sep. 23, 2011.
U.S. Appl. No. 13/260,986 in the name of Watanabe et al., filed Sep. 29, 2011.
U.S. Appl. No. 13/262,858 in the name of Bisaiji et al., filed Oct. 4, 2011.
U.S. Appl. No. 13/263,272 in the name of Bisaiji et al., filed Oct. 6, 2011.
U.S. Appl. No. 13/263,660 in the name of Umemoto et al., filed Oct. 7, 2011.

(56) References Cited

OTHER PUBLICATIONS

U.S. Appl. No. 13/264,062 in the name of Watanabe et al., filed Oct. 12, 2011.
U.S. Appl. No. 13/264,230 in the name of Bisadi et al., filed Oct. 13, 2011.
U.S. Appl. No. 13/264,594 in the name of Inoue et al., filed Oct. 14, 2011.
U.S. Appl. No. 13/264,884 in the name of Bisaiji et al., filed Oct. 17, 2011.
U.S. Appl. No. 13/375,674 in the name of Inoue at al., filed Dec. 1, 2011.
U.S. Appl. No. 13/580,000 in the name of Bisaiji et al., filed Aug. 20, 2012.
U.S. Appl. No. 13/582,862 in the name of Uenishi et al., filed Sep. 5, 2012.
U.S. Appl. No. 13/202,694 in the name of Bisaui et al., filed Sep. 19, 2011.
U.S. Appl. No. 14/108,113 in the name of Bisaiji et al., filed Dec. 16, 2013.
U.S. Appl. No. 14/152,629 in the name of Umemoto et al., filed Jan. 10, 2014.
U.S. Appl. No. 13/262,001 in the name of Inoue et al., filed Oct. 19, 2011.
Nov. 22, 2010 Written Opinion issued in International Patent Application No. PCT/JP2010/065186 (with translation).
Dec. 27, 2011 Written Opinion issued in International Patent Application No. PCT/JP2011/075618.
Aug. 6, 2014 Notice of Allowance in U.S. Appl. No. 13/259,574.
Nov. 27, 2013 Notice of Allowance issued in U.S. Appl. No. 13/258,483.
Oct. 4, 2013 Notice of Allowance issued in U.S. Appl. No. 13/259,885.
Jun. 15, 2010 International Search Report issued in PCT/JP2010/054740 (with translation).
Jun. 15, 2010 International Search Report issued in International Patent Application No. PCT/JP2010/054731 (with translation).
Jun. 29, 2010 International Search Report issued in International Patent Application No. PCT/JP2010/056345.
Jun. 15, 2010 International Search Report issued in International Patent Application No. PCT/JP2010/054729.
Sep. 13, 2011 International Search Report issued in International Patent Application No. PCT/JP2011/066628 (with translation).
Jun. 20, 2012 Search Report issued in European Patent Application No. 10845966.0.
Apr. 4, 2013 Office Action issued in U.S. Appl. No. 13/255,710.
Oct. 24, 2013 Office Action issued in U.S. Appl. No. 13/255,710.
Jan. 17, 2013 Office Action issued in U.S. Appl. No. 13/202,733.
Jan. 22, 2014 Office Action issued in U.S. Appl. No. 13/499,211.
May 27, 2014 Office Action issued in U.S. Appl. No. 13/255,710.
Oct. 2, 2014 Office Action issued in U.S. Appl. No. 13/582,862.
Jun. 15, 2010 Written Opinion issued in PCT/JP2010/054740 (with translation).
Sep. 18, 2014 Notice of Allowance issued in U.S. Appl. No. 13/255,710.
Jul. 9, 2013 Notice of Allowance issued in U.S. Appl. No. 13/255,774.
Dec. 9, 2013 Notice of Allowance issued in U.S. Appl. No. 13/262,506.
Dec. 27, 2013 Notice of Allowance issued in U.S. Appl. No. 13/502,210.
U.S. Appl. No. 13/255,774 in the name of Bisaiji et al., filed Sep. 22, 2011.
U.S. Appl. No. 13/255,710 in the name of Bisaiji et al., filed Oct. 12, 2011.
U.S. Appl. No. 13/502,210 in the name of Bisaiji et al., filed Apr. 16, 2012.
U.S. Appl. No. 13/499,211 in the name of Bisaiji et al., filed Mar. 29, 2012.
U.S. Appl. No. 13/934,080 in the name of Bisaiji et al., filed Jul. 2, 2013.
U.S. Appl. No. 13/262,506 in the name of Bisaiji et al., filed Sep. 30, 2011.
U.S. Appl. No. 13/264,230 in the name of Bisaiji et al., filed Oct. 13, 2011.
U.S. Appl. No. 13/202,694 in the name of Bisaiji et al., filed Sep. 19, 2011.
U.S. Appl. No. 13/202,733 in the name of Bisaiji et al., filed Sep. 30, 2011.
Dec. 22, 2014 Office Action issued in U.S. Appl. No. 13/264,230.
Jun. 3, 2015 Office Action issued in U.S. Appl. No. 14/152,629.

* cited by examiner

EXHAUST PURIFICATION SYSTEM OF INTERNAL COMBUSTION ENGINE

TECHNICAL FIELD

The present invention relates to an exhaust purification system of an internal combustion engine.

BACKGROUND ART

The exhaust of diesel engines, gasoline engines, and other internal combustion engines includes, for example, carbon monoxide (CO), unburned fuel (HC), nitrogen oxides ($NO_X$), particulate matter (PM), and other constituents. The internal combustion engines are mounted with exhaust purification systems for removing these constituents.

In the prior art exhaust purification systems, it is known to arrange an addition valve which feeds fuel or another additive at the upstream side of the catalyst which purifies the exhaust. By feeding an additive from the addition valve into the exhaust, it is possible to feed an additive to the catalyst.

Japanese Patent Publication No. 2009-156067 A1 discloses an exhaust gas purification system of an internal combustion engine which is provided with a fuel additive valve which adds fuel to the inside of an exhaust pipe. This publication discloses that an additive pool which pools the additive is arranged inside of the exhaust pipe through which fuel which has been injected from the fuel addition valve runs. It discloses that the additive pool be changed in area which receives the additive in accordance with the engine operation. It is disclosed that in this system, atomization of the additive can be promoted even if space for sufficient mixing cannot be secured between the fuel addition valve and the catalyst.

Japanese Patent Publication No. 2007-514104 A1 discloses an exhaust mechanism of an internal combustion engine for lean burn use which is provided with a particulate filter and a deflector which is arranged at the inlet of the particulate filter and which deflects at least part of the exhaust which flows through the exhaust mechanism. Further, it is disclosed that the deflector is formed into a frustoconical shape, has an upstream end which has a first sectional area and a downstream end which has a second sectional area, and has a second sectional area larger than the first sectional area.

Japanese Patent Publication No. 2009-030560 A1 discloses an exhaust purification system of an internal combustion engine which is provided with a reduction catalyst and a reducing agent injector. This exhaust purification system provides an exhaust introduction chamber at the upstream side of the reduction catalyst. The exhaust flows into the exhaust introduction chamber. The inlet side of the exhaust passage in which the reduction catalyst is arranged is extended toward the inside of the exhaust introduction chamber. At the end of the extended exhaust passage, a cover member in which a through hole for exhaust is provided is arranged. In the exhaust introduction chamber, a reducing agent injector is arranged. It is disclosed that the cover member includes a mixer for mixing and dispersing the reducing agent and exhaust. In this exhaust purification system, it is disclosed that it is possible to uniformly disperse the exhaust in which the reducing agent is mixed and feed it to the reduction catalyst.

CITATIONS LIST

Patent Literature

PLT 1: Japanese Patent Publication No. 2009-156067 A1
PLT 2: Japanese Patent Publication No. 2007-514104 A1
PLT 3: Japanese Patent Publication No. 2009-030560 A1

SUMMARY OF INVENTION

Technical Problem

In an exhaust purification system which feeds fuel to the engine exhaust passage, depending on the position of the addition valve which adds the fuel, the shape of the exhaust pipe, etc., when the fuel which is added to the inside of the exhaust pipe reaches the catalyst, sometimes unevenness locally occurs in the concentration. That is, sometimes exhaust which locally has parts with a high concentration of fuel and parts with a low one is fed to the catalyst. If the catalyst is not fed with exhaust of a uniform concentration of fuel, for example, the exhaust purification action is liable to end up being limited to the parts with a high concentration. As a result, sometimes the removal rate of the catalyst as a whole falls. Alternatively, if the concentration of fuel locally becomes too high, sometimes the catalyst slips through in the "slip" phenomenon. Alternatively, due to the occurrence of unevenness in the concentration of the fuel at the inside of the exhaust pipe, sometimes the fuel deposits at the wall surfaces of the exhaust pipe.

As disclosed in the above publications, by arranging a member for improving the dispersability of fuel at the upstream side of the catalyst, it is possible to feed exhaust made uniform in concentration of fuel to the catalyst. In this regard, these members for improving the dispersability have to be arranged inside of the exhaust pipe, so there is the problem that the exhaust purification system becomes larger. Further, due to a member for improving the dispersability being arranged inside of the exhaust pipe, there is the problem that the back pressure of the internal combustion engine ends up rising. That is, the problem arises that the member for improving the dispersability causes the flow sectional area to become smaller and the pressure loss of the exhaust purification system to become larger.

As a configuration which evens out the concentration of fuel at the inside of the exhaust pipe, the exhaust pipe at the upstream side of the catalyst can be lengthened. That is, by increasing the distance through which the exhaust flows through the inside of the exhaust pipe, the exhaust in which the fuel is contained can be agitated. However, in a configuration which lengthens the exhaust pipe, the exhaust purification system becomes larger and the back pressure rises. Further, due to the exhaust pipe becoming longer, the problem arises that the amount of fuel which deposits on the inside surface of the exhaust pipe also ends up increasing.

Furthermore, to improve the purification rate of exhaust, it is possible to increase the volume of the catalyst. In this regard, if increasing the volume of the catalyst, the problem arises that the exhaust purification system ends up becoming larger in size.

In this regard, as one method for removing the nitrogen oxides which are contained in exhaust, it is known to arrange an $NO_X$ storage catalyst in the engine exhaust passage. An $NO_X$ storage catalyst has the function of storing $NO_X$ which is contained in exhaust when the inflowing exhaust is lean in air-fuel ratio and of releasing and reducing the stored $NO_X$ when the inflowing exhaust becomes rich in air-fuel ratio. However, sometimes the $NO_X$ storage catalyst fell in $NO_X$ removal rate if becoming high in temperature.

The present invention has as its object to provide an exhaust purification system of an internal combustion engine which is small in size and excellent in $NO_X$ removal rate.

Solution to Problem

The exhaust purification system of an internal combustion engine of the present invention is provided inside of an engine exhaust passage with an exhaust purification catalyst for causing the $NO_X$ which is contained in exhaust and hydrocarbons to react. The exhaust purification catalyst includes an upstream side catalyst and a downstream side catalyst which are connected in series in the engine exhaust passage. The upstream side catalyst has an oxidizing ability. The downstream side catalyst carries catalyst particles of precious metals on an exhaust flow surface and forms basic exhaust flow surface parts around the catalyst particles. The exhaust purification catalyst has the property of reducing the $NO_X$ which is contained in exhaust if making the concentration of hydrocarbons which flow into the exhaust purification catalyst vibrate by within a predetermined range of amplitude and by within a predetermined range of period and has the property of the amount of storage of $NO_X$ which is contained in exhaust increasing if making the vibration period of the concentration of hydrocarbons longer than the above predetermined range. The system is formed so that, at the time of engine operation, control is performed to make the concentration of hydrocarbons which flow into the exhaust purification catalyst vibrate by within the predetermined range of amplitude and by within the predetermined range of period and reduce the $NO_X$ which is contained in the exhaust at the exhaust purification catalyst. The upstream side catalyst includes an upstream side substrate at which catalyst particles are carried and an upstream side container which contains the upstream side substrate. The downstream side catalyst includes a downstream side substrate at which catalyst particles are carried, a downstream side container which contains the downstream side substrate, and a channel of exhaust which is formed by the clearance part between the downstream side substrate and the downstream side container. The upstream side container is connected to the downstream side container. In the exhaust purification system, the exhaust which flows out from the upstream side substrate is divided toward a plurality of directions at the inside of the downstream side container and runs through the channel between the downstream side substrate and the downstream side container, then merges, then the merged exhaust flows into the downstream side substrate.

In the above invention, preferably the area of the end face of the upstream side substrate into which the exhaust flows is formed smaller than the area of the end face of the downstream side substrate into which the exhaust flows.

In the above invention, preferably the upstream side container is connected to the surface of the downstream side container in the peripheral direction, the upstream side substrate is arranged so that the exhaust which flows out from the upstream side substrate heads toward the outer surface of the downstream side substrate in the peripheral direction, and the exhaust which flows out from the upstream side substrate is divided into a plurality of directions at the outer surface of the downstream side gas in the peripheral direction.

In the above invention, preferably the upstream side catalyst has catalyst particles of precious metals, partially oxidizes the hydrocarbons which are contained in exhaust, and feeds the partially oxidized hydrocarbons to the downstream side catalyst.

Advantageous Effects of Invention

According to the present invention, it is possible to provide an exhaust purification system of an internal combustion engine which is small in size and excellent in $NO_X$ removal rate.

DESCRIPTION OF EMBODIMENTS

Referring to FIG. 1 to FIG. 24, an exhaust purification system of an internal combustion engine in an embodiment will be explained. In the present embodiment, a compression ignition type of internal combustion engine which is mounted in a vehicle will be taken up as an example for the explanation.

Figure 1:
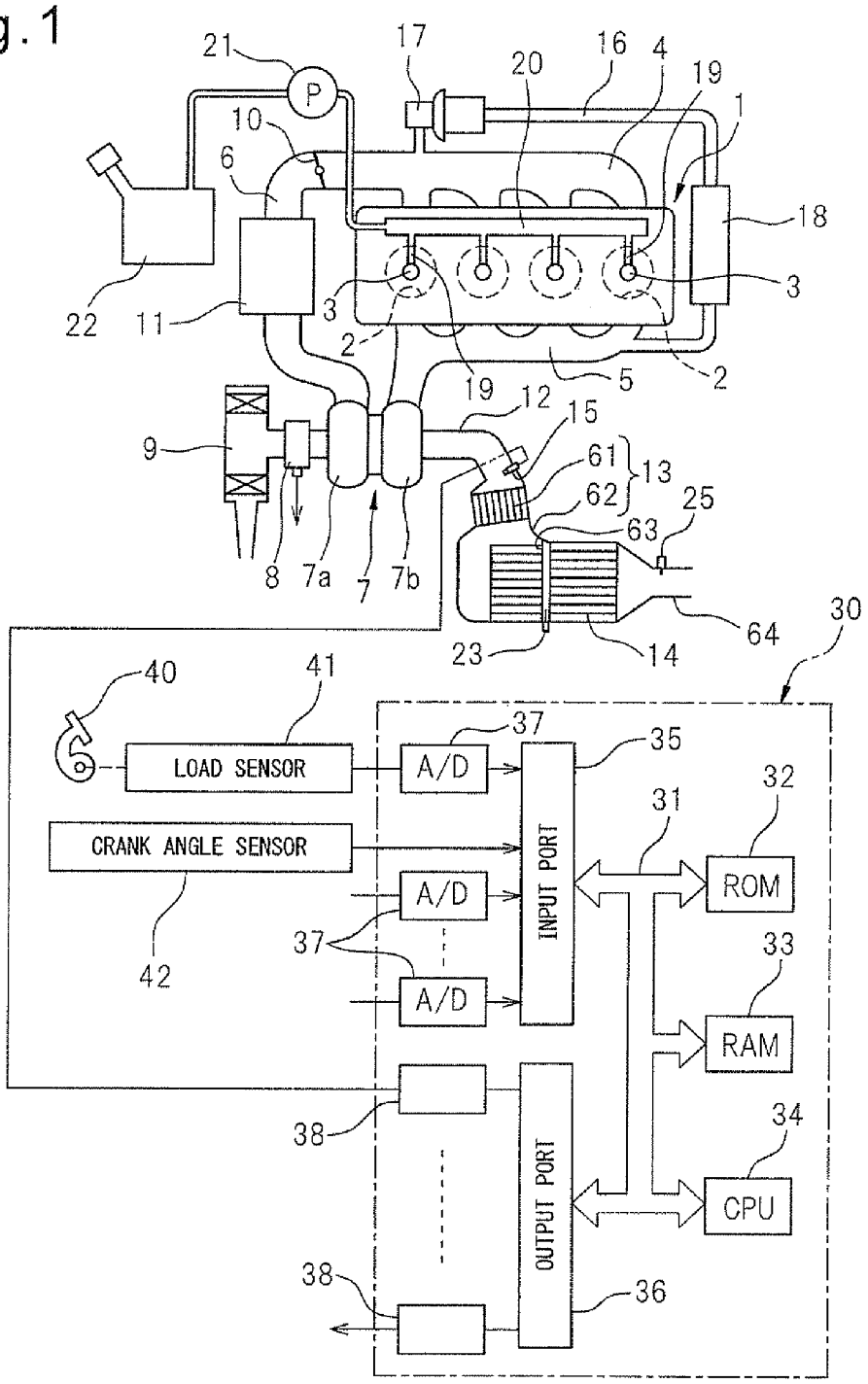
FIG. 1 is an overall view of a compression ignition type of an internal combustion engine in an embodiment.

FIG. 1 is an overall view of an internal combustion engine in the present embodiment. The internal combustion engine is provided with an engine body 1. Further, the internal combustion engine is provided with an exhaust purification system which purifies the exhaust. The engine body 1 includes combustion chambers 2 as cylinders, electronically controlled fuel injectors 3 for injecting fuel to the combustion chambers 2, an intake manifold 4, and an exhaust manifold 5.

The intake manifold 4 is connected through an intake duct 6 to an outlet of a compressor 7*a* of an exhaust turbocharger 7. An inlet of the compressor 7*a* is connected through an intake air detector 8 to an air cleaner 9. Inside the intake duct 6, a throttle valve 10 is arranged which is driven by a step motor. Furthermore, in the middle of the intake duct 6, a cooling device 11 is arranged for cooling the intake air which flows through the inside of the intake duct 6. In the embodiment which is shown in FIG. 1, engine cooling water is guided to the cooling device 11. The engine cooling water is used to cool the intake air.

On the other hand, the exhaust manifold 5 is connected to the inlet of the exhaust turbine 7*b* of the exhaust turbocharger 7. The exhaust purification system in the present embodiment is provided with an exhaust purification catalyst 13 which removes the $NO_X$ which is contained in the exhaust and a particulate filter 14 which traps particulate which is contained in the exhaust. The exhaust purification catalyst 13 causes the $NO_X$ and the hydrocarbons which are contained in the exhaust to react. The first exhaust purification catalyst 13 in the present embodiment includes an upstream side catalyst 61 and a downstream side catalyst 62. The exhaust purification catalyst 13 is connected through an exhaust pipe 12 to an outlet of the exhaust turbine 7*b*. The exhaust purification catalyst 13 is connected to the particulate filter 14. The particulate filter 14 is connected to an exhaust pipe 64.

Upstream of the exhaust purification catalyst 13, a hydrocarbon feed valve 15 is arranged for feeding hydrocarbons comprised of diesel oil which is used as the fuel of a compression ignition type internal combustion engine or other fuel. In the present embodiment, diesel oil is used as the hydrocarbons which are fed from the hydrocarbon feed valve 15. Note that, the present invention can also be applied to a spark ignition type of internal combustion engine in which the air-fuel ratio at the time of combustion is controlled to be lean. In this case, from the hydrocarbon feed valve, hydrocarbons comprised of gasoline which is used as the fuel of the spark ignition type of internal combustion engine or other fuel are fed.

Between the exhaust manifold 5 and the intake manifold 4, an EGR passage 16 is arranged for exhaust gas recirculation (EGR). In the EGR passage 16, an electronic control type of EGR control valve 17 is arranged. Further, in the middle of the EGR passage 16, a cooling device 18 is arranged for cooling the EGR gas which flows through the inside of the EGR passage 16. In the embodiment which is shown in FIG. 1, engine cooling water is guided to the inside of the cooling device 18. The engine cooling water is used to cool the EGR gas.

The respective fuel injectors 3 are connected through fuel feed tubes 19 to a common rail 20. The common rail 20 is connected through an electronic control type of variable discharge fuel pump 21 to a fuel tank 22. The fuel which is stored in the fuel tank 22 is fed by the fuel pump 21 to the inside of the common rail 20. The fuel which is fed to the common rail 20 is fed through the respective fuel feed tubes 19 to the fuel injectors 3.

An electronic control unit 30 in the present embodiment is comprised of a digital computer. The electronic control unit 30 in the present embodiment functions as a control device of the exhaust purification system. The electronic control unit 30 includes components which are connected to each other by a bidirectional bus 31 such as a ROM (read only memory) 32, RAM (random access memory) 33, CPU (microprocessor) 34, input port 35, and output port 36. The ROM 32 is a read only memory device. The ROM 32 stores in advance maps and other information which are required for control. The CPU 34 can perform any computations or judgment. The RAM 33 is a random access memory device. The RAM 33 can store operational history or other information or store results of computations.

Downstream of the downstream side catalyst 62, a temperature sensor 23 is attached for detecting the temperature of the downstream side catalyst 62. Downstream of the particulate filter 14, a temperature sensor 25 is arranged which detects the temperature of the particulate filter 14. The output signals of the temperature sensors 23 and 25 and intake air detector 8 are input through respectively corresponding AD converters 37 to the input port 35.

Further, an accelerator pedal 40 has a load sensor 41 connected to it which generates an output voltage which is proportional to the amount of depression of the accelerator pedal 40. The output voltage of the load sensor 41 is input through a corresponding AD converter 37 to the input port 35. Furthermore, the input port 35 has connected to it a crank angle sensor 42 which generates an output pulse every time the crankshaft rotates by for example 15°. The output of the crank angle sensor 42 can be used to detect the crank angle or the engine speed. On the other hand, the output port 36 is connected through corresponding drive circuits 38 to the fuel injectors 3, step motor for driving the throttle valve 10, hydrocarbon feed valve 15, EGR control valve 17, and fuel pump 21. These fuel injectors 3, throttle valve 10, hydrocarbon feed valve 15, EGR control valve 17, etc. are controlled by the electronic control unit 30.

The particulate filter 14 is a filter which removes carbon particles, sulfates, and other particulate which is contained in the exhaust. The particulate filter 14, for example, has a honeycomb structure and has a plurality of channels which extend in the direction of flow of the gas. In the plurality of channels, channels with downstream ends sealed and channels with upstream ends sealed are alternately formed. The partition walls of the channels are formed by a porous material such as cordierite. If the exhaust is passed through the partition walls, the particulate is trapped. The particulate which is contained in exhaust is trapped by the particulate filter 14 and oxidized. The particulate which gradually builds up on the particulate filter 14 is removed by oxidation by raising the temperature inside an air-rich atmosphere to for example 650° C. or so.

Figure 2A:
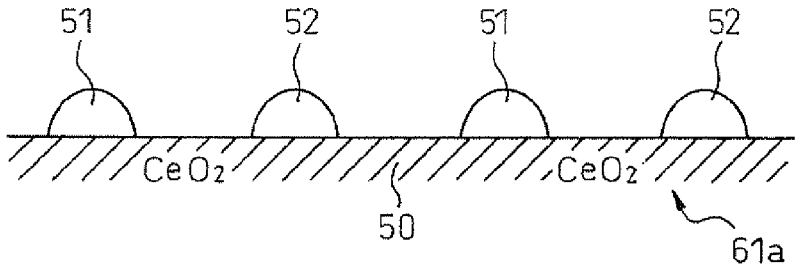
FIG. 2A is an enlarged schematic view of a surface part of a catalyst carrier in an upstream side catalyst.

FIG. 2A schematically shows a surface part of the catalyst carrier which is carried on the substrate of the upstream side catalyst of the exhaust purification catalyst. The upstream side catalyst 61 is comprised of a catalyst which has an oxidation ability. The upstream side catalyst 61 in the present embodiment has a configuration similar to a three-way catalyst which has an oxygen storage ability. A three-way catalyst has the function of simultaneously decreasing the HC, CO, and $NO_X$ which are contained in exhaust at the time of feedback control so that the air-fuel ratio of the inflowing exhaust becomes the stoichiometric air-fuel ratio. As shown in FIG. 2A, catalyst particles 51, 52 of precious metals are carried on a catalyst carrier 50, which is for example comprised of alumina, of the upstream side catalyst 61. In the example which is shown in FIG. 2A, the catalyst particles 51 are comprised of platinum Pt, while the catalyst particles 52 are comprised of rhodium Rh.

On the other hand, in the example which is shown in FIG. 2A, the catalyst carrier 50 of the upstream side catalyst 61 contains cerium Ce. This cerium Ce takes in oxygen and takes the form of ceria $CeO_2$ under an oxygen rich oxidizing atmosphere while releases oxygen and takes the form of $Ce_2O_3$ under a reducing atmosphere. That is, the catalyst carrier 50 absorbs oxygen under an oxidizing atmosphere and releases oxygen under a reducing atmosphere. In this way, the catalyst carrier 50 in the present embodiment has an oxygen absorption/release function. When the catalyst carrier 50 does not have such an oxygen absorption/release function, if the oxygen concentration in the exhaust gas is decreased, the oxidizing power of the upstream side catalyst 61 weakens.

As opposed to this, if the catalyst carrier 50 has an oxygen absorption/release function, if the oxygen concentration of the exhaust becomes smaller, oxygen is released from the catalyst carrier 50. Further, this oxygen is extremely high in activity. Therefore, when the catalyst carrier 50 has an oxygen absorption/release function, that is, when the upstream side catalyst 61 has an oxygen storage ability, even if the air-fuel ratio of the exhaust becomes rich, the upstream side catalyst 61 has a high oxidizing power.

Figure 2B:
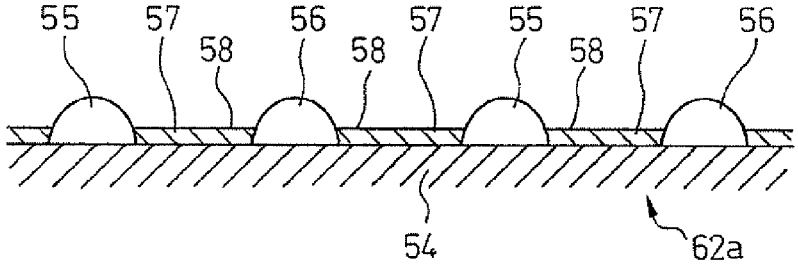
FIG. 2B is an enlarged schematic view of a surface part of a catalyst carrier in a downstream side catalyst.

FIG. 2B schematically shows a surface part of the catalyst carrier which is carried on the substrate of the downstream side catalyst. In the downstream side catalyst 62, precious metal catalyst particles 55, 56 are carried on a catalyst carrier 54 comprised of for example alumina. Furthermore, on the catalyst carrier 54, a basic layer 57 is formed which includes at least one element selected from potassium K, sodium Na, cesium Cs, or other such alkali metal, barium Ba, calcium Ca, or other such alkali earth metal, a lanthanide and other rare earths and silver Ag, copper Cu, iron Fe, iridium Ir, and other such metals able to donate electrons to $NO_X$. The exhaust flows along the catalyst carrier 54, so the catalyst particles 55, 56 can be said to be carried on the exhaust flow surface of the downstream side catalyst 62. Further, the surface of the basic layer 57 exhibits basicity, so the surface of the basic layer 57 is called a "basic exhaust flow surface part 58".

On the other hand, in FIG. 2B, the precious metal catalyst particles 55 are comprised of platinum Pt, while the precious metal catalyst particles 56 are comprised of rhodium Rh. That is, the catalyst particles 55, 56 which are carried on the catalyst carrier 54 are comprised of platinum Pt and rhodium Rh. Note that, the catalyst carrier 54 of the downstream side catalyst 62 can further carry palladium Pd in addition to platinum Pt and rhodium Rh or can carry palladium Pd instead of rhodium Rh. That is, the catalyst particles 55, 56 which are carried on the catalyst carrier 54 are comprised of platinum Pt and at least one of rhodium Rh and palladium Pd.

Figure 3:
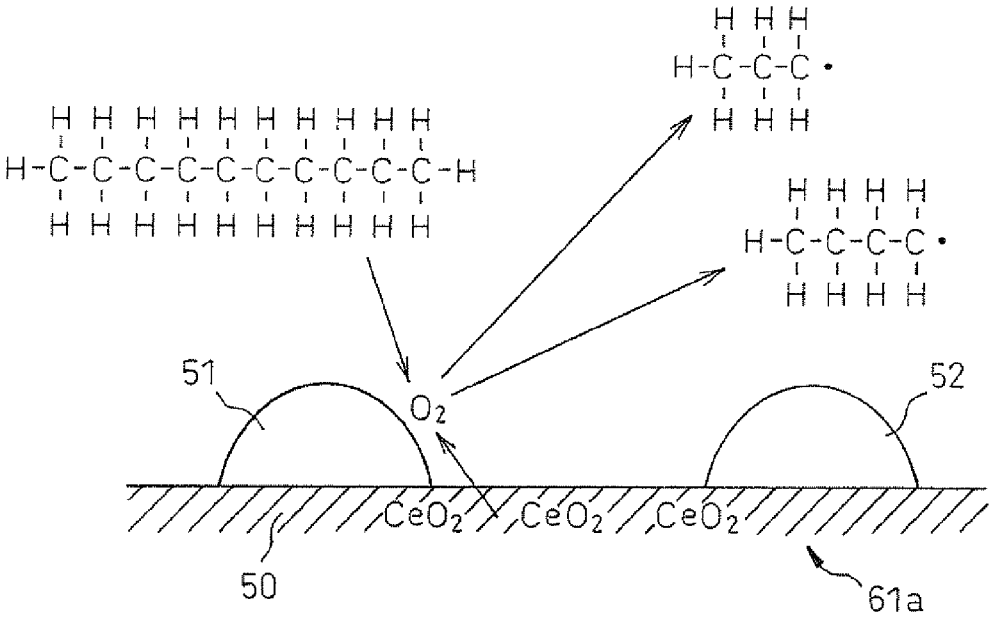
FIG. 3 is a view which explains an oxidation reaction of hydrocarbons in an upstream side catalyst.

FIG. 3 schematically shows a surface part of the catalyst carrier which is carried on the substrate of the upstream side catalyst of the exhaust purification catalyst. If hydrocarbons are injected from the hydrocarbon feed valve 15 into the exhaust, the hydrocarbons are reformed at the upstream side catalyst 61. That is, the hydrocarbons HC which are injected from the hydrocarbon feed valve 15 become radical state hydrocarbons HC with few carbon atoms due to the catalytic action of the upstream side catalyst 61. In the present invention, the hydrocarbons which were reformed at this time are used to remove the $NO_X$ at the downstream side catalyst 62. Note that, at this time, if the area above the catalyst carrier 50 of the upstream side catalyst 61 becomes a reducing atmosphere, as shown schematically in FIG. 3, oxygen is released from the catalyst carrier 50. Due to the released oxygen, the hydrocarbons are reformed to radical state hydrocarbons with few carbon atoms.

Further, even if injecting the fuel, that is, the hydrocarbons, from the fuel injectors 3 to the inside of the combustion chambers 2 in the second half of the expansion stroke or during the exhaust stroke, the hydrocarbons are reformed inside the combustion chambers 2 or at the upstream side catalyst 61, and the $NO_X$ which is contained in the exhaust is removed by the reformed hydrocarbons. Therefore, in the present invention, instead of feeding hydrocarbons from the hydrocarbon feed valve 15 to the inside of the engine exhaust passage, it is also possible to feed hydrocarbons to the insides of the combustion chambers 2 in the second half of the expansion stroke or during the exhaust stroke. In this way, in the present invention, it is possible to feed hydrocarbons into the combustion chambers 2, but below the case of injecting hydrocarbons from the hydrocarbon feed valve 15 to the inside of the engine exhaust passage will be used as an example for explaining the present invention.

Figure 4:
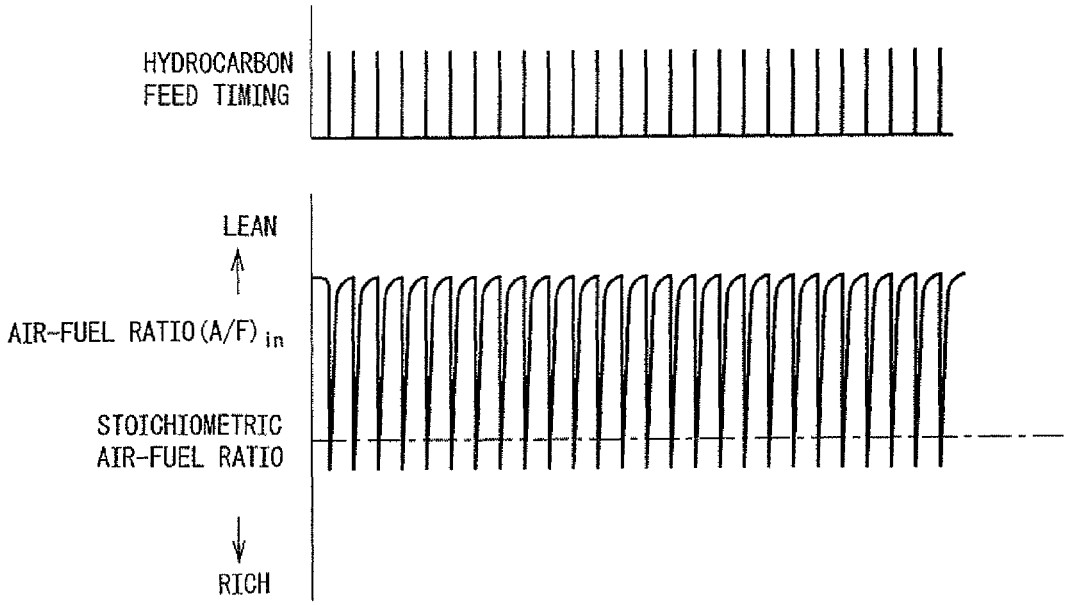
FIG. 4 is a view which shows changes in an air-fuel ratio of exhaust which flows into an exhaust purification catalyst in a first $NO_X$ removal method.

FIG. 4 shows the timing of feed of hydrocarbons from the hydrocarbon feed valve 15 and the change in the air-fuel ratio (A/F)in of the exhaust which flows into the exhaust purification catalyst 13. Note that, the change of the air-fuel ratio (A/F)in depends on the change in the concentration of hydrocarbons in the exhaust which flows into the exhaust purification catalyst 13, so the change in the air-fuel ratio (A/F)in which is shown in FIG. 4 can be said to express the change in the concentration of hydrocarbons. However, if the concentration of hydrocarbons becomes higher, the air-fuel ratio (A/F)in becomes smaller, so in FIG. 4, the richer the air-fuel ratio (A/F)in, the higher the concentration of hydrocarbons.

Figure 5:
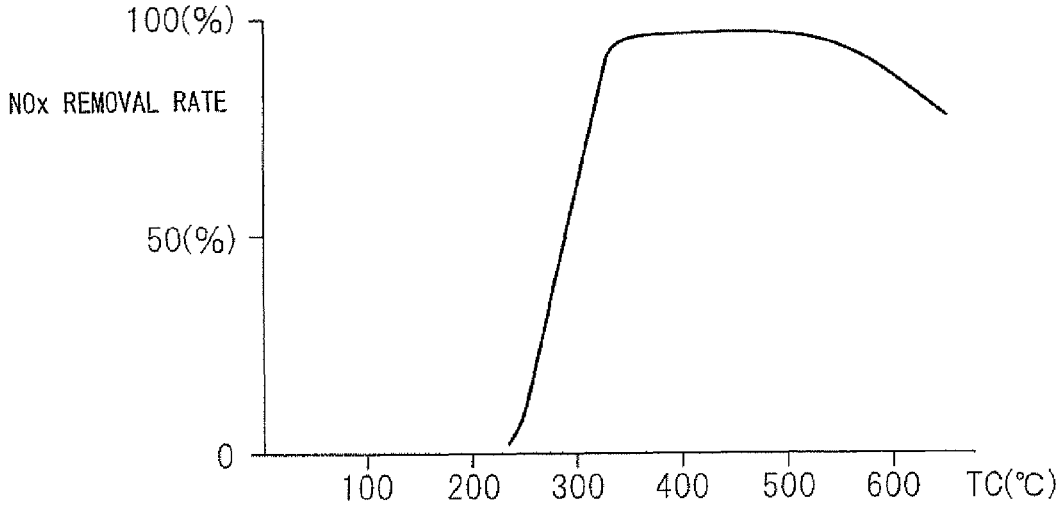
FIG. 5 is a view which shows an $NO_X$ removal rate of the first $NO_X$ removal method.

FIG. 5 shows the $NO_X$ removal rate by the exhaust purification catalyst 13 with respect to each catalyst temperature TC of the exhaust purification catalyst 13 when periodically changing the concentration of hydrocarbons which flow into the exhaust purification catalyst 13 so as to change the air-fuel ratio (A/F)in of the exhaust which flows into the exhaust purification catalyst 13 as shown in FIG. 4. The inventors engaged in extensive research on $NO_X$ removal over a long period of time and in the process of the research learned that if making the concentration of hydrocarbons which flow into the exhaust purification catalyst 13 vibrate by within a predetermined range of amplitude and by within a predetermined range of period, as shown in FIG. 5, an extremely high $NO_X$ removal rate is obtained even in the high temperature region of 400° C. or more.

Furthermore, at this time, they learned that a large amount of reducing intermediates containing nitrogen and hydrocarbons is produced in the exhaust purification catalyst 13 and these reducing intermediates play a central role in obtaining a high $NO_X$ removal rate.

Figure 6A:
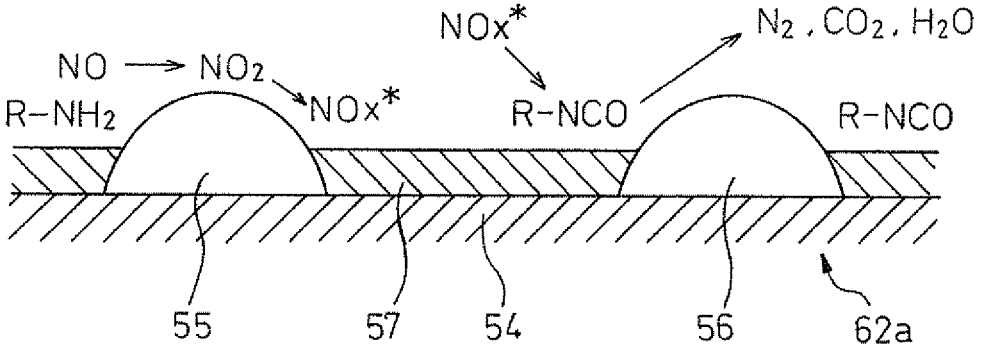
FIG. 6A is an enlarged schematic view which explains production of active $NO_X$ and reaction of reducing intermediates at a downstream side catalyst of the first $NO_X$ removal method.
Figure 6B:
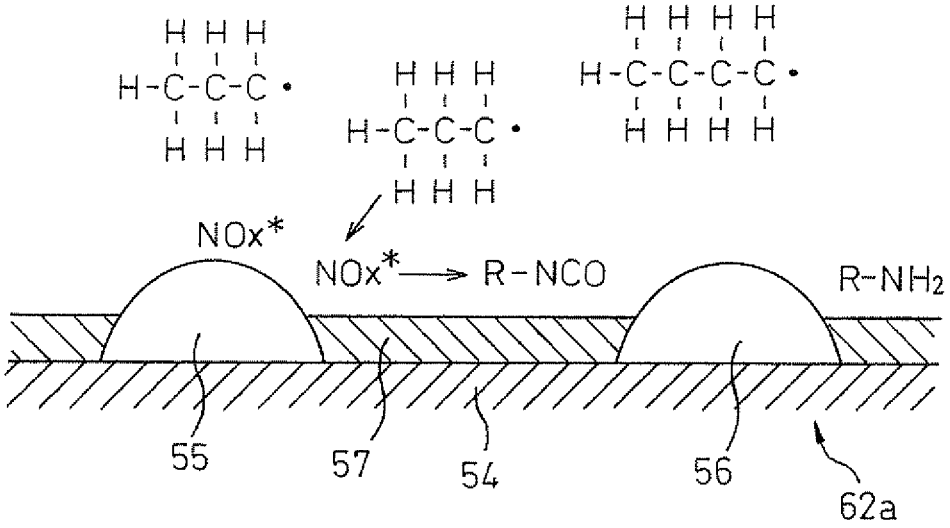
FIG. 6B is an enlarged schematic view which explains production of reducing intermediates in a downstream side catalyst of the first $NO_X$ removal method.

Next, this will be explained with reference to FIG. 6A and FIG. 6B. Note that, FIG. 6A and FIG. 6B schematically show surface parts of the catalyst carrier 54 of the downstream side catalyst 62. FIG. 6A and FIG. 6B show the reaction which is presumed to occur when making the concentration of hydrocarbons which flow into the exhaust purification catalyst 13 vibrate by within a predetermined range of amplitude and by within a predetermined range of period.

FIG. 6A shows when the concentration of hydrocarbons which flows into the exhaust purification catalyst is low. As will be understood from FIG. 4, the air-fuel ratio of the exhaust which flows into the exhaust purification catalyst 13 is maintained lean except for an instant, so the exhaust which flows into the downstream side catalyst 62 usually becomes an excess of oxygen. Therefore, the NO which is contained in the exhaust is oxidized on the catalyst particles 55 and becomes $NO_2$, then this $NO_2$ is further oxidized and becomes $NO_3$. Further, part of the $NO_2$ becomes $NO_2^-$. In this case, the amount of production of $NO_3$ is far greater than the amount of production of $NO_2^-$. Therefore, on the catalyst particles 55, a large amount of $NO_3$ and a small amount of $NO_2^-$ are produced. These $NO_3$ and $NO_2^-$ are strong in activity. Below, these $NO_3$ and $NO_2^-$ will be called "active $NO_X$". These active $NO_X$ are held by deposition or adsorption on the surface of the basic layer 57.

Next, when hydrocarbons are fed from the hydrocarbon feed valve 15, as shown in FIG. 3, at the upstream side catalyst 61, the hydrocarbons which are contained in the exhaust are partially oxidized. The hydrocarbons are reformed inside the upstream side catalyst 61 to become radical in state. The reformed hydrocarbons are fed to the downstream side catalyst 62.

FIG. 6B shows when hydrocarbons are fed from the hydrocarbon feed valve and the concentration of hydrocarbons which flow into the exhaust purification catalyst becomes higher. If the concentration of hydrocarbons which flow into the downstream side catalyst 62 becomes higher, the concentration of hydrocarbons around the active $NO_X$ becomes higher. If the concentration of hydrocarbons around the active $NO_X$ becomes higher, the active $NO_X$ reacts with the radical state hydrocarbons HC on the catalyst particles whereby reducing intermediates are produced.

Note that, the reducing intermediate which is first produced at this time is believed to be the nitro compound R—$NO_2$. This nitro compound R—$NO_2$ becomes the nitrile compound R—CN when produced, but this nitrile compound R—CN can only survive in that state for an instant, so immediately becomes the isocyanate compound R—NCO. This isocyanate compound R—NCO becomes the amine compound R—$NH_2$ if hydrolyzed. However, in this case, what is hydrolyzed is believed to be part of the isocyanate compound R—NCO. Therefore, as shown in FIG. 6B, the majority of the reducing intermediates which are produced is believed to be the isocyanate compound R—NCO and amine compound R—$NH_2$. The large amount of reducing intermediates which are produced inside of the downstream side catalyst 62 are deposited or adsorbed on the surface of the basic layer 57.

Next, as shown in FIG. 6A, if the concentration of hydrocarbons which flow into the exhaust purification catalyst 13 becomes lower, at the downstream side catalyst 62, the active $NO_X$ and the produced reducing intermediates react. In this regard, after the active $NO_X$ is held on the surface of the basic layer 57 in this way or after the active $NO_X$ is produced, if the state of a high concentration of oxygen around the active $NO_X$ continues for a certain time period or more, the active $NO_X$ is oxidized and is absorbed inside the basic layer 57 in the form of nitric acid ions $NO_3^-$. However, if the reducing intermediates are produced before this certain time period elapses, as shown in FIG. 6A, the active $NO_X$ reacts with the reducing intermediates R—NCO or R—$NH_2$ to become $N_2$, $CO_2$, or $H_2O$ and therefore the $NO_X$ is removed. Note that, in this case, it is necessary to hold a sufficient amount of reducing intermediates R—NCO or R—$NH_2$ on the surface of the basic layer 57, that is, on the basic exhaust flow surface parts 58, until the produced reducing intermediates react with the active $NO_X$. The basic exhaust flow surface parts 58 are provided for this reason.

In this way, the concentration of hydrocarbons which flow into the exhaust purification catalyst 13 is temporarily made high to produce reducing intermediates and the produced reducing intermediates are made to react with the active $NO_X$ to remove the $NO_X$. That is, to use the exhaust purification catalyst 13 to remove the $NO_X$, it is necessary to periodically change the concentration of hydrocarbons which flow into the exhaust purification catalyst 13.

Of course, in this case, it is necessary to raise the concentration of hydrocarbons to a concentration sufficiently high for producing the reducing intermediates. That is, it is necessary to make the concentration of hydrocarbons which flow into the exhaust purification catalyst 13 vibrate by within a predetermined range of amplitude.

On the other hand, if lengthening the feed period of hydrocarbons, the time period during which the concentration of oxygen becomes higher in the interval after hydrocarbons are fed to when hydrocarbons are next fed becomes longer and therefore the active $NO_X$ is absorbed inside the basic layer 57 in the form of nitrates without producing reducing intermediates. To avoid this, it is necessary to make the concentration of hydrocarbons which flow into the exhaust purification catalyst 13 vibrate by within a predetermined range of period. Incidentally, in the example which is shown in FIG. 4, the injection interval is made 3 seconds.

Figure 7A:
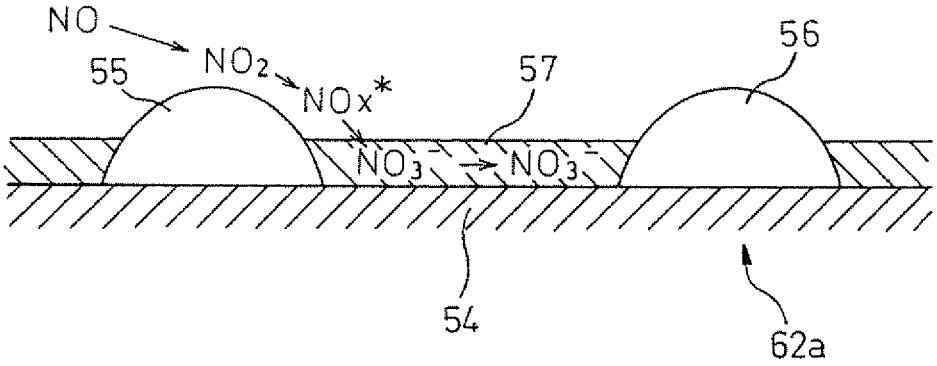
FIG. 7A is an enlarged schematic view which explains storage of $NO_X$ in a downstream side catalyst of a second $NO_X$ removal method.

As explained above, if making the vibration period of the concentration of hydrocarbons, that is, the period of feed of hydrocarbons HC, longer than a predetermined range of period, at the downstream side catalyst 62, the active $NO_X$ diffuses in the basic layer 57 in the form of nitric acid ions $NO_3^-$ as shown in FIG. 7A and becomes nitrates. That is, at this time, the $NO_X$ in the exhaust is absorbed inside the basic layer 57 in the form of nitrates.

Figure 7B:
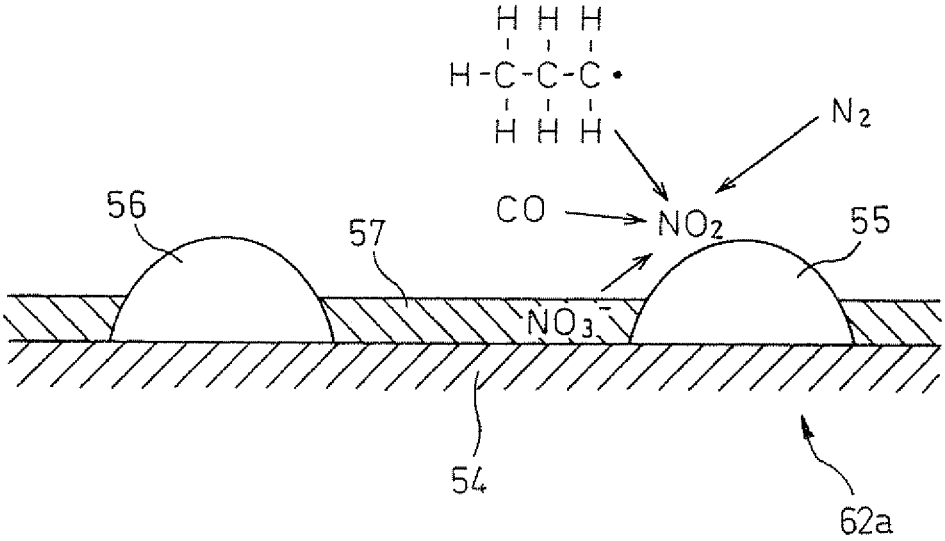
FIG. 7B is an enlarged schematic view which explains release and reduction of $NO_X$ in a downstream side catalyst of the second $NO_X$ removal method.

On the other hand, FIG. 7B shows the case where when, in this way, $NO_X$ is absorbed in the basic layer 57 in the form of nitrates, the air-fuel ratio of the exhaust which flows into the exhaust purification catalyst 13 is made the stoichiometric air-fuel ratio or rich. In this case, the concentration of oxygen in the exhaust falls, so the reaction proceeds in the opposite direction ($NO_3^- \rightarrow NO_2$) and therefore the nitrates which are absorbed inside the basic layer 57 successively become nitric acid ions $NO_3^-$ and, as shown in FIG. 79, are released in the form of $NO_2$ from the basic layer 57. Next, the released $NO_2$ is reduced by the hydrocarbons HC and CO which are contained in the exhaust.

Figure 8:
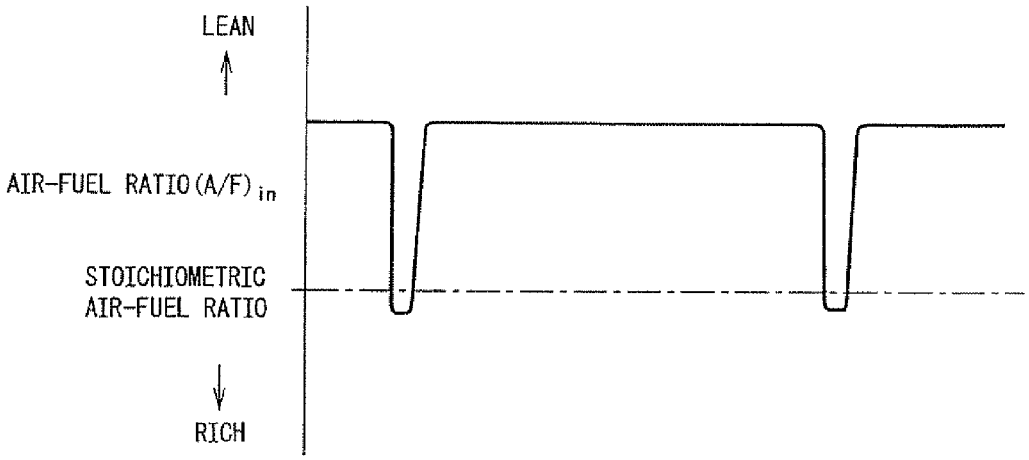
FIG. 8 is a view which shows changes in an air-fuel ratio of exhaust which flows into a downstream side catalyst in the second $NO_X$ removal method.

FIG. 8 shows the case of making the air-fuel ratio (A/F)in of the exhaust which flows into the exhaust purification catalyst 13 temporarily rich slightly before the $NO_X$ absorption ability of the basic layer 57 becomes saturated. Note that, in the example which is shown in FIG. 8, the time interval of this rich control is 1 minute or more. In this case, the $NO_X$ which was absorbed inside the basic layer 57 when the air-fuel ratio (A/F)in of the exhaust is lean is released all at once from the basic layer 57 and reduced when the air-fuel ratio (A/F)in of the exhaust is made temporarily rich. Therefore, in this case, the basic layer 57 performs the role of an absorbent for temporarily absorbing the $NO_X$.

Note that, at this time, sometimes the basic layer 57 temporarily adsorbs the $NO_X$. Therefore, if using the term "storage" as a term including both absorption and adsorption, at this time the basic layer 57 performs the role of an $NO_X$ storage agent for temporarily storing the $NO_X$. That is, in this case, if referring to the ratio of the air and fuel (hydrocarbons) which are fed into the engine intake passage, combustion chambers 2, and exhaust passage upstream of the upstream side catalyst 61 as the "air-fuel ratio of the exhaust", the downstream side catalyst 62 functions as an $NO_X$ storage catalyst which stores the $NO_X$ when the air-fuel ratio of the exhaust is lean and releases the stored $NO_X$ when the concentration of oxygen in the exhaust falls.

Figure 9:
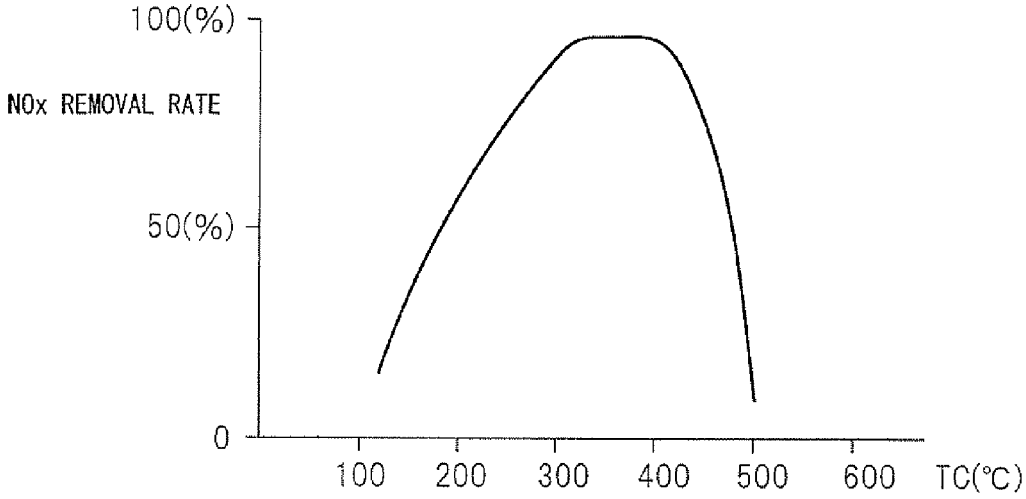
FIG. 9 is a view which shows an $NO_X$ removal rate of the second $NO_X$ removal method.

FIG. 9 shows the $NO_X$ removal rate when making the exhaust purification catalyst function as an $NO_X$ storage catalyst in this way. Note that, the abscissa of FIG. 9 indicates the catalyst temperature TC of the downstream side catalyst 62. When making the exhaust purification catalyst 13 function as an $NO_X$ storage catalyst, as shown in FIG. 9, when the temperature TC of the downstream side catalyst 62 is from 300° C. to 400° C., an extremely high $NO_X$ removal rate is obtained, but if the catalyst temperature TC becomes a 400° C. or more high temperature, the $NO_X$ removal rate falls.

In this way, the $NO_X$ removal rate falls if the catalyst temperature TC becomes 400° C. or more because if the catalyst temperature TC becomes 400° C. or more, nitrates break down by heat and are released in the form of $NO_2$ from the exhaust purification catalyst 13. That is, so long as storing $NO_X$ in the form of nitrates, when the catalyst temperature TC is high, a high $NO_X$ removal rate is hard to obtain. However, in the new $NO_X$ removal method which is shown from FIG. 4 to FIG. 6A and FIG. 6B, as will be understood from FIG. 6A and FIG. 6B, nitrates are not produced or even if produced are extremely small in amount. Therefore, as shown in FIG. 5, even when the catalyst temperature TC is high, a high $NO_X$ removal rate is obtained.

In this way, the exhaust purification system of the present embodiment has the property of reducing the $NO_X$ which is contained in the exhaust if making the concentration of hydrocarbons which flow into the exhaust purification catalyst 13 vibrate by within a predetermined range of amplitude and by within a predetermined range of period and has the property of the amount of storage of $NO_X$ which is contained in the exhaust increasing if making the vibration period of the concentration of hydrocarbons longer than a predetermined range. The system is formed so that, at the time of engine operation, control is performed to make the concentration of hydrocarbons which flow into the exhaust purification catalyst 13 vibrate by within a predetermined range of amplitude and by within a predetermined range of period and reduce the $NO_X$ which is contained in the exhaust at the exhaust purification catalyst 13.

That is, the $NO_X$ removal method which is shown from FIG. 4 to FIG. 6A and FIG. 6B can be said to be a new $NO_X$ removal method designed to remove the $NO_X$ without forming almost any nitrates when using a catalyst which carries precious metal catalyst particles and forms a basic layer which can absorb the $NO_X$. In actuality, when using this new $NO_X$ removal method, the amount of nitrates which are detected from the basic layer 57 becomes extremely small compared to when making the exhaust purification catalyst 13 function as an $NO_X$ storage catalyst. Note that, this new $NO_X$ removal method will be referred to below as the "first $NO_X$ removal method".

Next, this first $NO_X$ removal method will be explained in a bit more detail while referring to FIG. 10 to FIG. 15.

Figure 10:
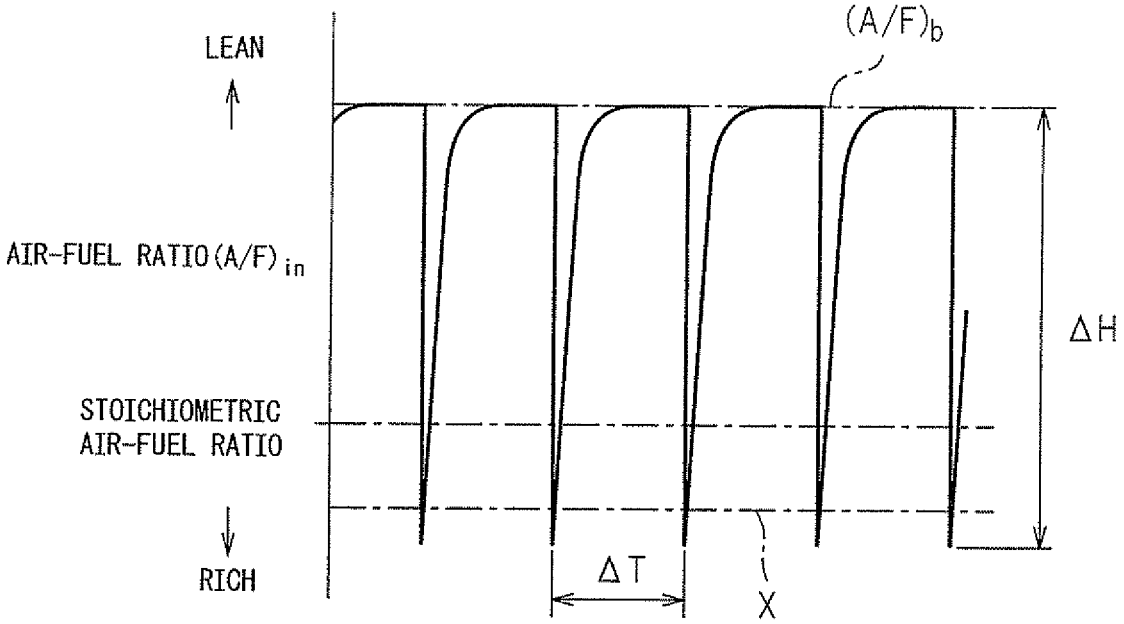
FIG. 10 is a time chart which shows changes in the air-fuel ratio of exhaust which flows into an exhaust purification catalyst in the first $NO_X$ removal method.

FIG. 10 shows the change in the air-fuel ratio (A/F)in which is shown in FIG. 4 enlarged. Note that, as explained above, the change in the air-fuel ratio (A/F)in of the exhaust which flows into the exhaust purification catalyst 13 simultaneously shows the change in the concentration of hydrocarbons which flow into the exhaust purification catalyst 13. Note that, in FIG. 10, ΔH shows the amplitude of the change in concentration of the hydrocarbons HC which flow into the exhaust purification catalyst 13, while ΔT shows the vibration period of the concentration of hydrocarbons which flow into the exhaust purification catalyst 13.

Furthermore, in FIG. 10, (A/F)b expresses the base air-fuel ratio which shows the air-fuel ratio of the combustion gas for generating the engine output. In other words, this base air-fuel ratio (A/F)b expresses the air-fuel ratio of the exhaust which flows into the exhaust purification catalyst 13 when stopping the feed of hydrocarbons. On the other hand, in FIG. 10, X shows the upper limit of the air-fuel ratio (A/F)in which enables production of a sufficient amount of reducing intermediates from the active $NO_X$ and reformed hydrocarbons and enables reaction of the active $NO_X$ with the reducing intermediates without causing it to be stored in the form of nitrates in the basic layer 57. To cause production of a sufficient amount of reducing intermediates from the active $NO_X$ and reformed hydrocarbons and cause reaction of the active $NO_X$ with the reducing intermediates without causing it to be stored in the form of nitrates in the basic layer 57, it is necessary to make the air-fuel ratio (A/F)in lower than the upper limit X of the air-fuel ratio.

In other words, X of FIG. 10 expresses the lower limit of the concentration of hydrocarbons which is necessary for production of a sufficient amount of reducing intermediates and reacting the active $NO_X$ with the reducing intermediates. To cause production of a sufficient amount of reducing intermediates and cause reaction of the active $NO_X$ with the reducing intermediates, it is necessary to raise the concentration of hydrocarbons to above this lower limit X as well. In this case, whether a sufficient amount of reducing intermediates is produced and the active $NO_X$ reacts with the reducing intermediates is determined by the ratio between concentration of oxygen and the concentration of hydrocarbons around the active $NO_X$, that is, the air-fuel ratio (A/F)in. The above-mentioned upper limit X of the air-fuel ratio which is necessary for causing production of a sufficient amount of reducing intermediates and causing the active $NO_X$ to react with the reducing intermediates will be referred to below as the "demanded minimum air-fuel ratio".

Figure 11:
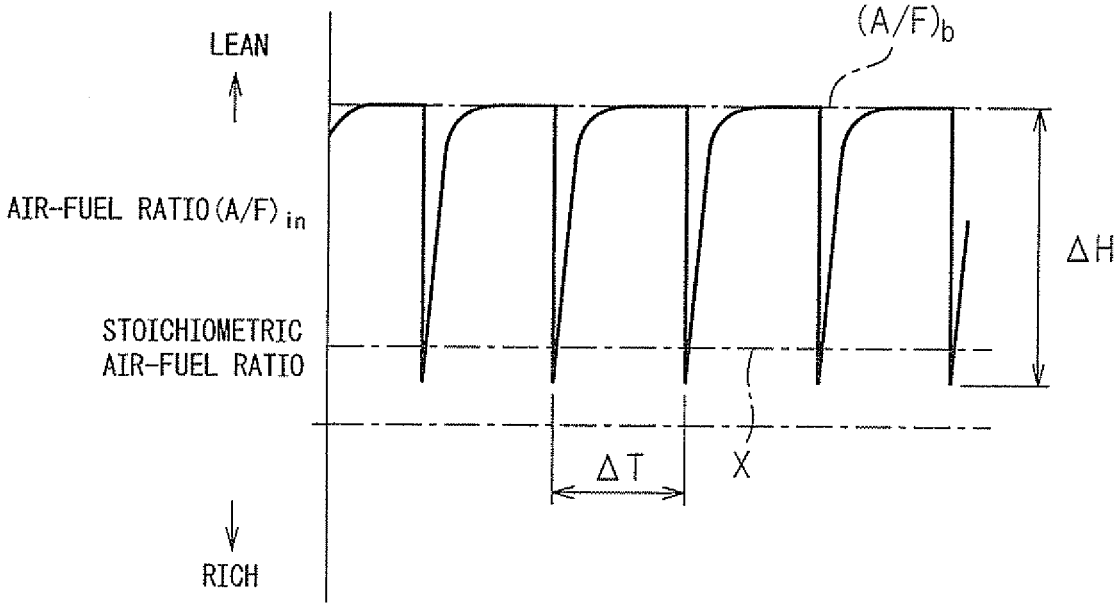
FIG. 11 is another time chart which shows changes in the air-fuel ratio of exhaust which flows into an exhaust purification catalyst in the first $NO_X$ removal method.

In the example which is shown in FIG. 10, the demanded minimum air-fuel ratio X becomes rich. Therefore, in this case, to cause production of a sufficient amount of reducing intermediates and make the active $NO_X$ react with the reducing intermediates, the air-fuel ratio (A/F)in is instantaneously made the demanded minimum air-fuel ratio X or less, that is, rich. As opposed to this, in the example which is shown in FIG. 11, the demanded minimum air-fuel ratio X is lean. In this case, the air-fuel ratio (A/F)in is maintained lean while periodically lowering the air-fuel ratio (A/F)in so as to produce a sufficient amount of reducing intermediates and react the active $NO_X$ with the reducing intermediates.

In this case, whether the demanded minimum air-fuel ratio X becomes rich or lean depends on the oxidizing power of the upstream side catalyst 61. In this case, the upstream side catalyst 61 for example becomes stronger in oxidizing power if increasing the amount of precious metal carried and becomes stronger in oxidizing power if strengthening the acidity. Therefore, the oxidizing power of the upstream side catalyst 61 changes depending on the amount of the precious metal carried or the strength of the acidity.

Now, when using an upstream side catalyst 61 with a strong oxidizing power, as shown in FIG. 11, if maintaining the air-fuel ratio (A/F)in lean while periodically lowering the air-fuel ratio (A/F)in, when the air-fuel ratio (A/F)in is lowered, the hydrocarbons end up being completely oxidized and as a result the reducing intermediates can no longer be produced. As opposed to this, when using an upstream side catalyst 61 with a strong oxidizing power, as shown in FIG. 10, if periodically making the air-fuel ratio (A/F)in rich, the hydrocarbons are partially oxidized without being completely oxidized when the air-fuel ratio (A/F)in is made rich, that is, the hydrocarbons are reformed, and therefore a sufficient amount of reducing intermediates is produced and the active $NO_X$ is made to react with the reducing intermediates. Therefore, when using an upstream side catalyst 61 with a strong oxidizing power, the demanded minimum air-fuel ratio X has to be made rich.

On the other hand, when using an upstream side catalyst 61 with a weak oxidizing power, as shown in FIG. 11, if maintaining the air-fuel ratio (A/F)in lean while periodically lowering the air-fuel ratio (A/F)in, the hydrocarbons are partially oxidized without being completely oxidized, that is, the hydrocarbons are reformed, and therefore a sufficient amount of reducing intermediates is produced and the active $NO_X$ is made to react with the reducing intermediates. As opposed to this, if using an upstream side catalyst 61 with a weak oxidizing power, as shown in FIG. 10, if making the air-fuel ratio (A/F)in periodically rich, a large amount of hydrocarbons is simply exhausted from the upstream side catalyst 61 without being oxidized and therefore the amount of hydrocarbons which is wastefully consumed increases. Therefore, when using an upstream side catalyst 61 with a weak oxidizing power, the demanded minimum air-fuel ratio X must be made lean.

Figure 12:
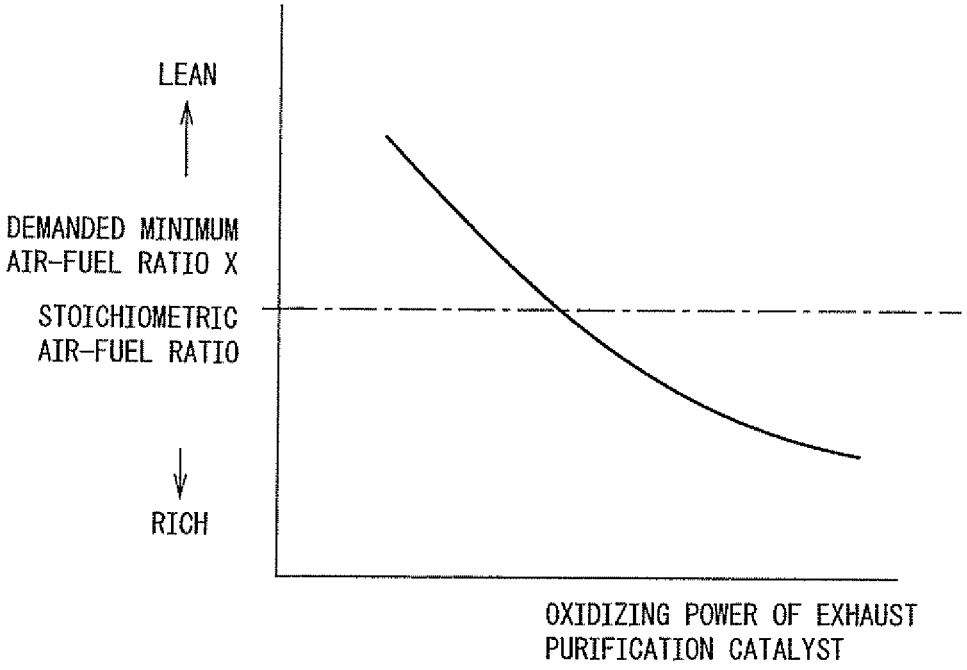
FIG. 12 is a view which shows the relationship between the oxidizing power of an exhaust purification catalyst and a demanded minimum air-fuel ratio X in the first $NO_X$ removal method.

That is, it is learned that the demanded minimum air-fuel ratio X, as shown in FIG. 12, has to be lowered the stronger the oxidizing power of the upstream side catalyst 61. In this way, the demanded minimum air-fuel ratio X is made lean or rich by the oxidizing power of the upstream side catalyst 61, but below the case where the demanded minimum air-fuel ratio X is rich will be used as an example to explain the amplitude of the change in the concentration of hydrocarbons which flow into the exhaust purification catalyst 13 or the vibration period of the concentration of hydrocarbons which flow into the exhaust purification catalyst 13.

Now then, if the base air-fuel ratio (A/F)b becomes larger, that is, if the concentration of oxygen in the exhaust before the hydrocarbons are fed becomes higher, the amount of feed of hydrocarbons required for making the air-fuel ratio (A/F)in the demanded minimum air-fuel ratio X or less increases. Therefore, the higher the concentration of oxygen in the exhaust before hydrocarbons are fed, the larger the amplitude of the concentration of hydrocarbons has to be made.

Figure 13:
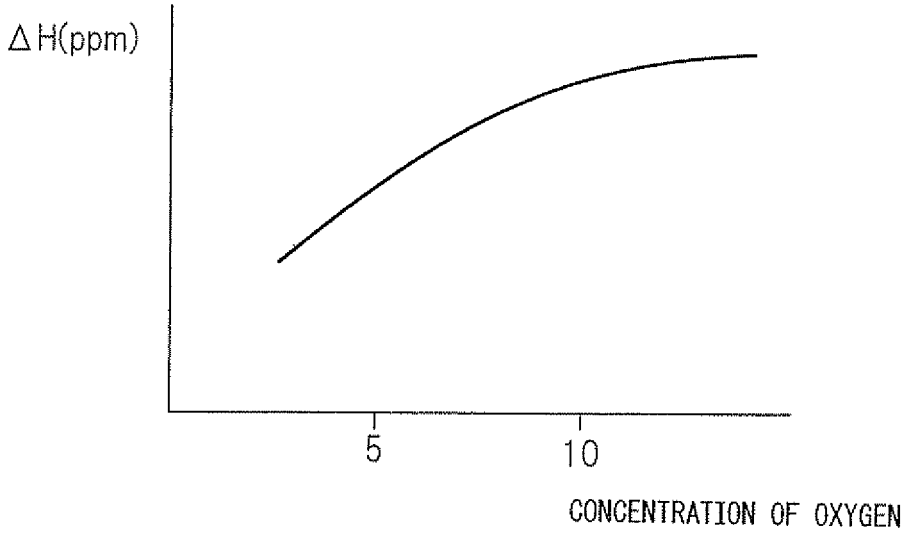
FIG. 13 is a view which shows the relationship between a concentration of oxygen in exhaust and an amplitude $\Delta H$ of the concentration of hydrocarbons which gives the same $NO_X$ removal rate in the first $NO_X$ removal method.

FIG. 13 shows the relationship between the concentration of oxygen in the exhaust before hydrocarbons are fed and the amplitude ΔH of the concentration of hydrocarbons when the same $NO_X$ removal rate is obtained. From FIG. 13, it is learned that to obtain the same $NO_X$ removal rate, the higher the concentration of oxygen in the exhaust before hydrocarbons are fed, the more the amplitude ΔH of the concentration of hydrocarbons has to be increased. That is, to obtain the same $NO_X$ removal rate, the higher the base air-fuel ratio (A/F)b, the more the amplitude ΔH of the concentration of hydrocarbons has to be increased. In other words, to remove the $NO_X$ well, it is possible to reduce the amplitude ΔH of the concentration of hydrocarbons the lower the base air-fuel ratio (A/F)b becomes.

Figure 14:
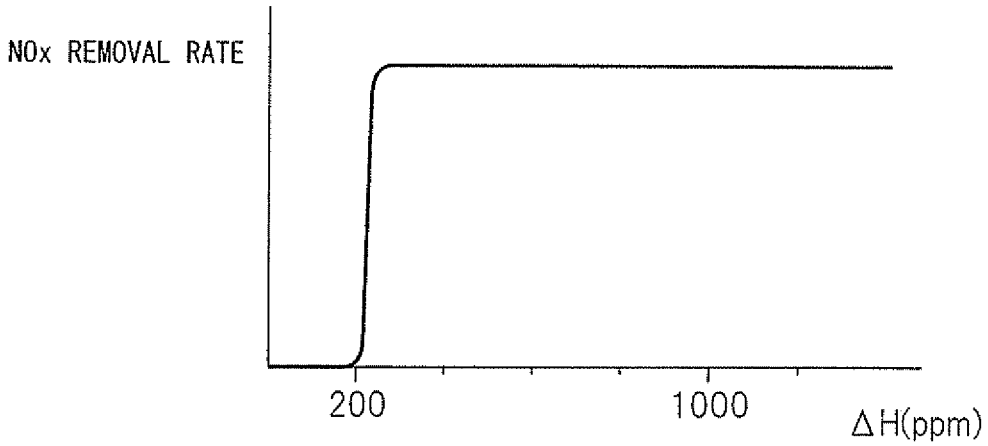
FIG. 14 is a view which shows the relationship between an amplitude $\Delta H$ of the concentration of hydrocarbons and an $NO_X$ removal rate in the first $NO_X$ removal method.

In this regard, the base air-fuel ratio (A/F)b becomes the lowest at the time of acceleration operation. At this time, if the amplitude ΔH of the concentration of hydrocarbons is 200 ppm or so, $NO_X$ can be removed well. The base air-fuel ratio (A/F)b usually becomes larger than the time of acceleration operation. Therefore, as shown in FIG. 14, a good $NO_X$ removal rate can be obtained if the amplitude ΔH of the concentration of hydrocarbon is 200 ppm or more.

On the other hand, it is learned that when the base air-fuel ratio (A/F)b is the highest, if making the amplitude ΔH of the concentration of hydrocarbons 10000 ppm or so, a good $NO_X$ removal rate can be obtained. Therefore, in the present invention, the predetermined range of amplitude of the concentration of hydrocarbons is made 200 ppm to 10000 ppm.

Figure 15:
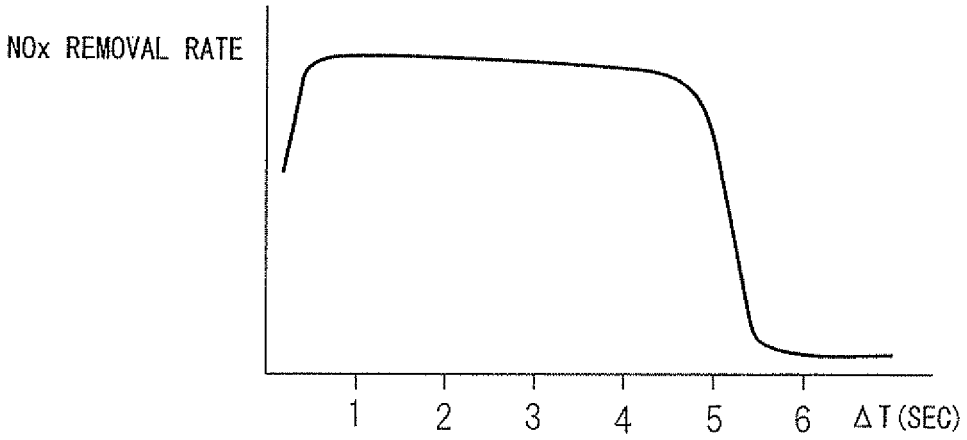
FIG. 15 is a view which shows the relationship between a vibration period $\Delta T$ of the concentration of hydrocarbons and an $NO_X$ removal rate in the first $NO_X$ removal method.

Further, if the vibration period ΔT of the concentration of hydrocarbons becomes longer, the concentration of oxygen around the active $NO_X$ becomes higher in the interval after hydrocarbons are fed to when hydrocarbons are next fed. In this case, if the vibration period ΔT of the concentration of hydrocarbons becomes longer than 5 seconds or so, the active $NO_X$ starts to be absorbed inside the basic layer 57 in the form of nitrates. Therefore, as shown in FIG. 15, if the vibration period ΔT of the concentration of hydrocarbons becomes longer than 5 seconds or so, the $NO_X$ removal rate falls. Therefore, the vibration period ΔT of the concentration of hydrocarbons has to be made 5 seconds or less.

On the other hand, if the vibration period ΔT of the concentration of hydrocarbons becomes about 0.3 second or less, the fed hydrocarbons start to build up on the exhaust purification catalyst 13. Therefore, as shown in FIG. 15, if the vibration period ΔT of the concentration of hydrocarbons becomes about 0.3 second or less, the $NO_X$ removal rate falls. Therefore, in the present invention, the vibration period of the concentration of hydrocarbons is made an interval of 0.3 second to 5 seconds.

Figure 16:
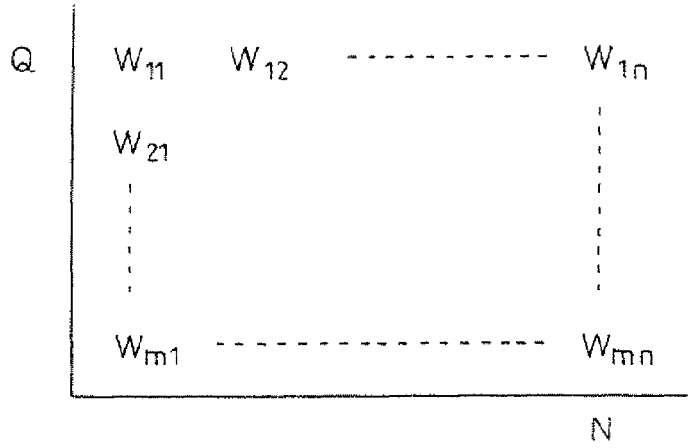
FIG. 16 is a view which shows a map of a hydrocarbon feed amount W in the first $NO_X$ removal method.

Now, in the present invention, control is performed to change the amount of feed of hydrocarbons and injection timing from the hydrocarbon feed valve 15 so that the amplitude ΔH of the concentration of hydrocarbons and the vibration period ΔT become the optimum values corresponding to the operating state of the engine. In this case, in an embodiment of the present invention, the amount of feed W of hydrocarbons which can give the optimum amplitude ΔH of the concentration of hydrocarbons is stored in advance inside the ROM 32 as a function of the amount of injection Q from the fuel injectors 3 and the engine speed N in the form of a map as shown in FIG. 16. Further, the optimum vibration amplitude ΔT of the concentration of hydrocarbons, that is, injection period ΔT of hydrocarbons, is similarly stored as a function of the amount of injection Q and engine speed N in the form of a map in the ROM 32.

Next, referring to FIG. 17 to FIG. 20, the method of removal of $NO_X$ when making the exhaust purification catalyst 13 function as an $NO_X$ storage catalyst will be explained in detail. The method of $NO_X$ removal when making the exhaust purification catalyst 13 function as an $NO_X$ storage catalyst in this way will be referred to below as the "second $NO_X$ removal method".

Figure 17:
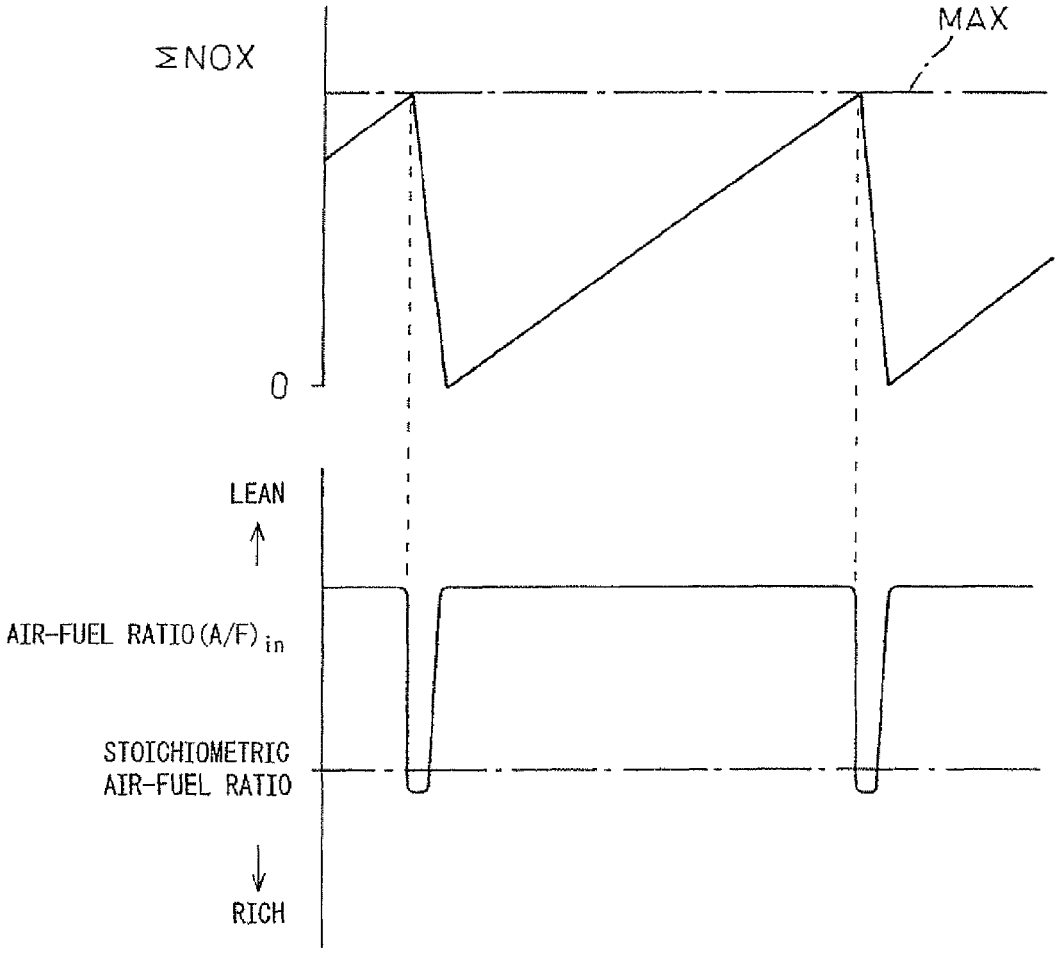
FIG. 17 is a view which shows an amount of $NO_X$ which is stored in the exhaust purification catalyst and a change of the air-fuel ratio of exhaust which flows into the exhaust purification catalyst in the second $NO_X$ removal method.

In this second $NO_X$ removal method, as shown in FIG. 17, when the stored $NO_X$ amount $\Sigma NO_X$ which is stored in the basic layer 57 exceeds a predetermined allowable amount MAX, the air-fuel ratio (A/F)in of the exhaust which flows into the exhaust purification catalyst 13 is temporarily made rich. If the air-fuel ratio (A/F)in of the exhaust is made rich, the $NO_X$ which was stored in the basic layer 57 when the air-fuel ratio (A/F)in of the exhaust was lean is released all at once from the basic layer 57 and reduced. Due to this, the $NO_X$ is removed.

Figure 18:
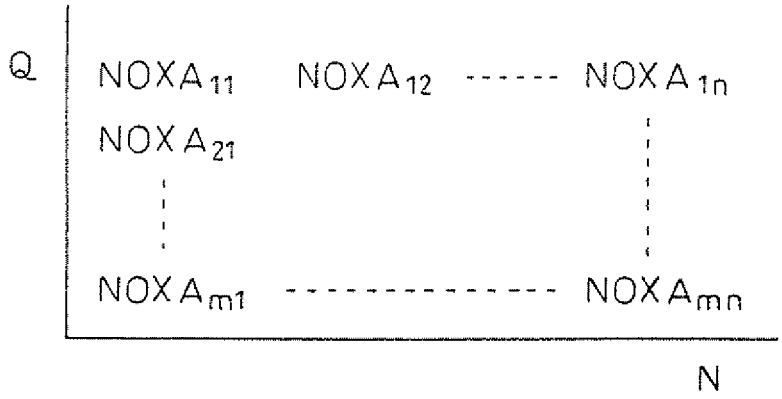
FIG. 18 is a view which shows a map of an $NO_X$ amount NOXA which is exhausted from an engine body.

The stored $NO_X$ amount $\Sigma NO_X$, for example, is calculated from the amount of $NO_X$ which is exhausted from the engine. In an embodiment according to the present invention, the exhausted $NO_X$ amount NOXA which is exhausted from the engine per unit time is stored as a function of the amount of injection Q and engine speed N in the form of the map such as shown in FIG. 18 in advance in the ROM 32. The stored $NO_X$ amount $\Sigma NO_X$ is calculated from this exhausted $NO_X$ amount NOXA. In this case, as explained above, the period during which the air-fuel ratio (A/F)in of the exhaust is made rich is usually 1 minute or more.

Figure 19:
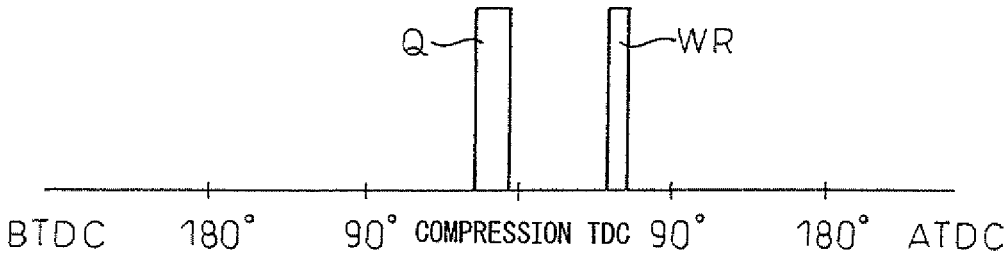
FIG. 19 is a view which shows a fuel injection timing in a combustion chamber in the second $NO_X$ removal method.
Figure 20:
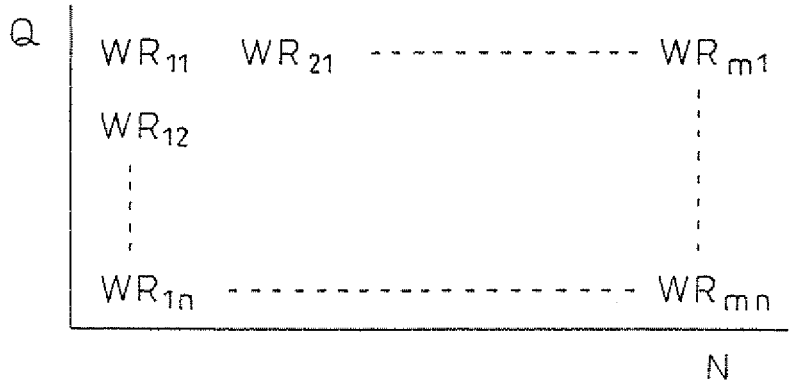
FIG. 20 is a view which shows a map of a hydrocarbon feed amount WR in the second $NO_X$ removal method.

In this second $NO_X$ removal method, as shown in FIG. 19, by performing auxiliary injection which injects additional fuel WR in addition to the main injection which injects combustion use fuel Q into the combustion chambers 2 from the fuel injectors 3, the air-fuel ratio (A/F)in of the exhaust which flows into the exhaust purification catalyst 13 is made rich. Note that, the abscissa in FIG. 19 shows the crank angle. This additional fuel WR is injected at a timing where it burns, but does not become engine output, that is, slightly before ATDC90° after top dead center of compression. This amount of fuel WR is stored as a function of the amount of injection Q and engine speed N in the form of the map such as shown in FIG. 20 in advance in the ROM 32. Of course, in this case, it is possible to increase the amount of feed of hydrocarbons from the hydrocarbon feed valve 15 so as to make the air-fuel ratio (A/F)in of the exhaust rich.

Now then, to remove the $NO_X$ which is exhausted from the engine well, the more the amount of $NO_X$ which is exhausted from the engine is increased, the more the amount of feed of hydrocarbons must be increased. In this regard, if the amount of feed of hydrocarbons is increased, the air-fuel ratio (A/F)in of the exhaust which flows into the exhaust purification catalyst 13 becomes lean near the stoichiometric air-fuel ratio or becomes rich. As a result, the concentration of oxygen in the exhaust becomes lower, so a partial oxidation reaction of hydrocarbons becomes harder and therefore reducing intermediates become hard to produce.

However, the upstream side catalyst 61 in the present embodiment has an oxygen storage ability, so even if the concentration of oxygen of the exhaust falls, oxygen is released from the upstream side catalyst 61 and as a result the partial oxidation reaction of the hydrocarbons becomes actively performed. Therefore, even if the amount of feed of hydrocarbons is increased, a sufficient amount of reducing intermediates is produced and the active $NO_X$ can be made to sufficiently react with the reducing intermediates, so a good $NO_X$ removal rate can be secured.

Note that, the upstream side catalyst of the exhaust purification catalyst in the present embodiment has an oxygen storage ability, but the invention is not limited to this. The upstream side catalyst may also not have an oxygen storage ability. Further, the upstream side catalyst in the present embodiment has a configuration of catalyst particles similar to the configuration of catalyst particles of a three-way catalyst, but the invention is not limited to this. The upstream side catalyst can carry any catalyst particles which exhibit an oxidation ability. That is, the upstream side catalyst can employ any catalyst which can partially oxidize and reform hydrocarbons. For example, the upstream side catalyst need not carry catalyst particles of a single precious metal.

Figure 21:
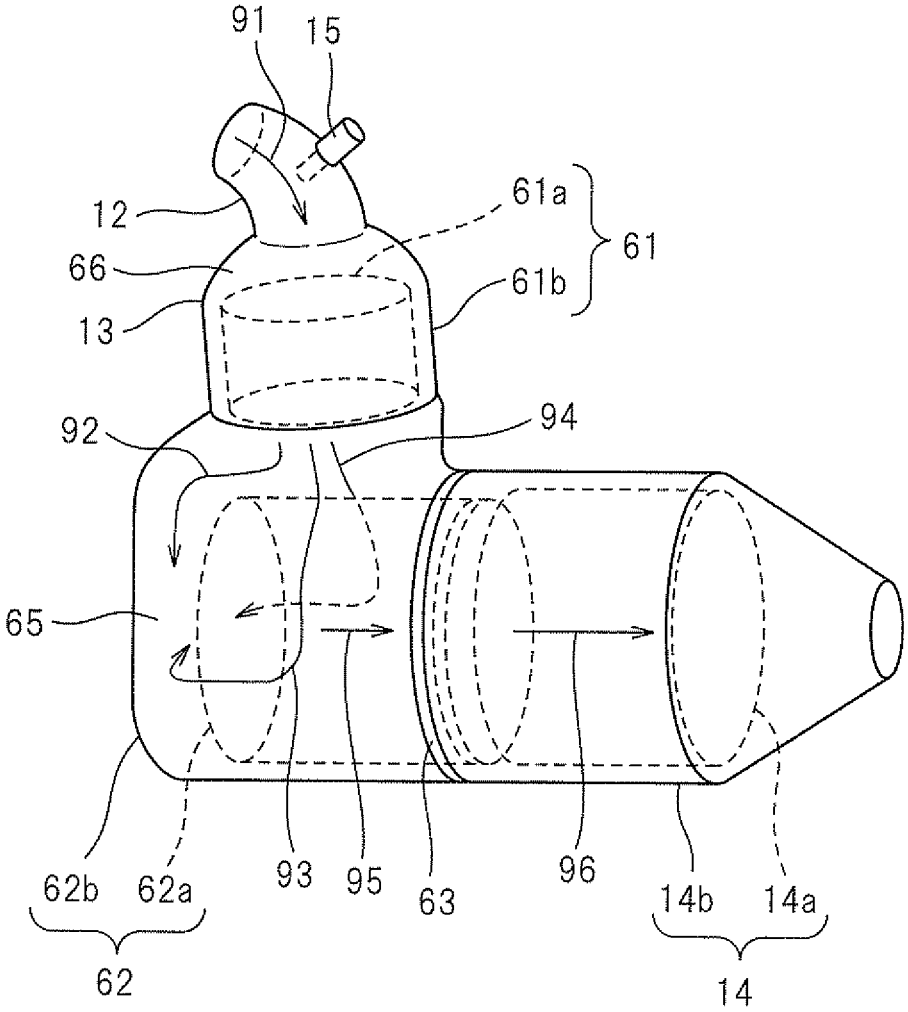
FIG. 21 is a schematic perspective view of an exhaust purification system in an embodiment.
Figure 22:
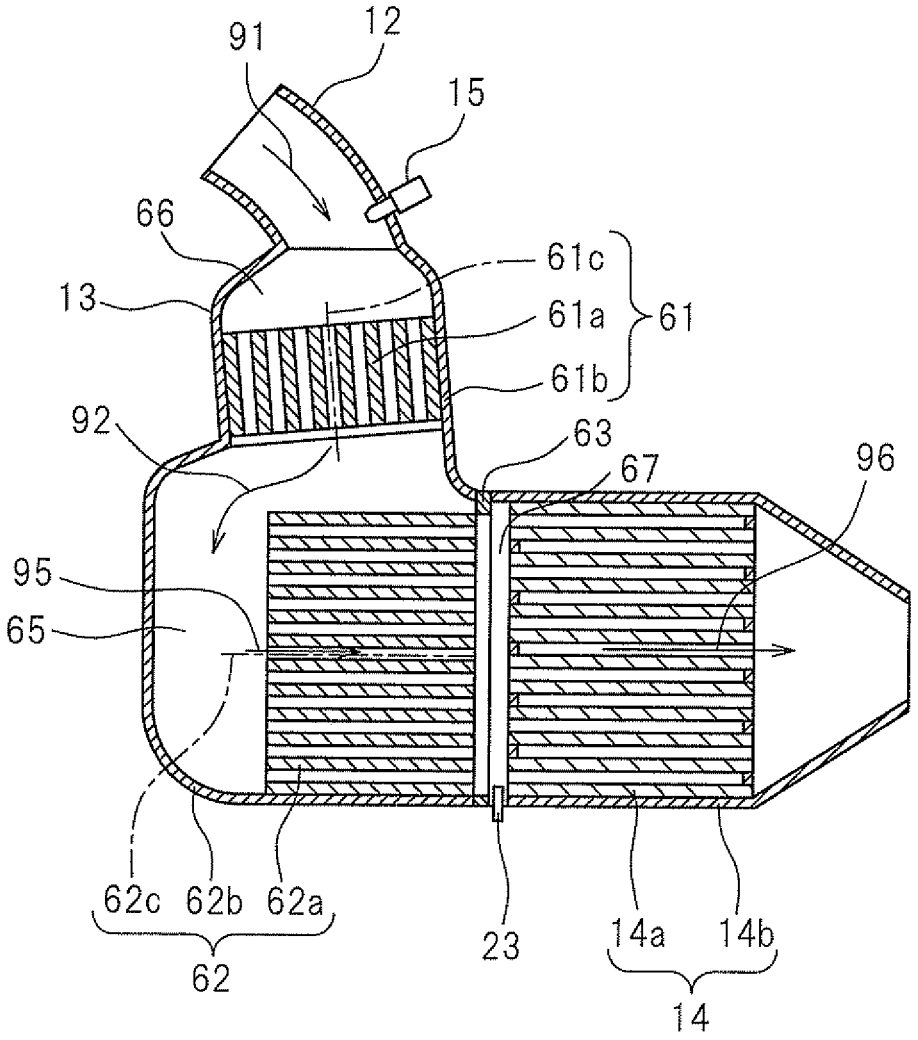
FIG. 22 is a first schematic cross-sectional view of an exhaust purification system in an embodiment.
Figure 23:
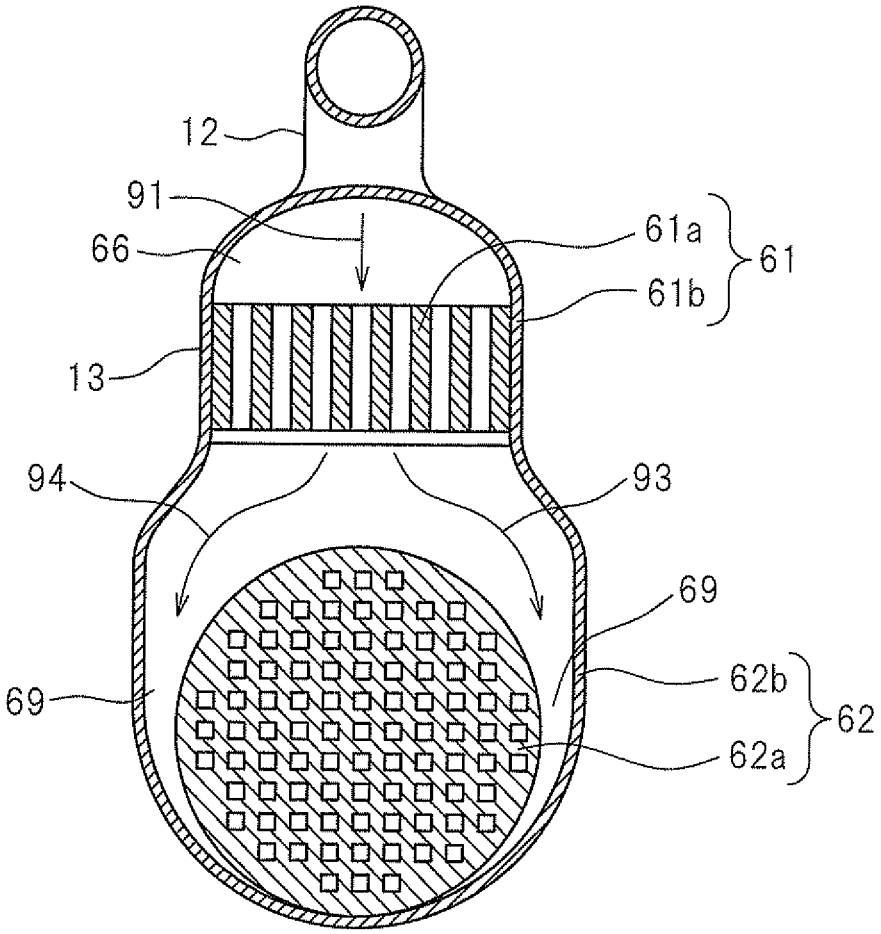
FIG. 23 is a second schematic cross-sectional view of an exhaust purification system in an embodiment.

Next, the structure of the exhaust purification system in the present embodiment will be explained. FIG. 21 is a schematic perspective view of an exhaust purification system in the present embodiment. FIG. 22 is a first schematic cross-sectional view of an exhaust purification system in the present embodiment. FIG. 22 is a cross-sectional view when cutting along the plane parallel to the axial direction of the downstream side catalyst. FIG. 23 is a second schematic cross-sectional view of an exhaust purification system in the present embodiment. FIG. 23 is a cross-sectional view when cutting along the plane which extends in a direction vertical to the axial direction of the downstream side catalyst.

Referring to FIG. 21 to FIG. 23, the upstream side catalyst 61 and the downstream side catalyst 62 are connected in series in the engine exhaust passage. The downstream side catalyst 62 is arranged at the downstream side from the upstream side catalyst 61. The particulate filter 14 in the present embodiment is arranged at the downstream side of the downstream side catalyst 62.

The upstream side catalyst 61 includes an upstream side substrate 61*a* on which the catalyst particles 51, 52 are carried and an upstream side container 61*b* which contains the upstream side substrate 61*a*. The upstream side substrate 61*a* in the present embodiment is formed into a honeycomb structure. The upstream side substrate 61*a* in the present embodiment is formed into a columnar shape. At the inside of the upstream side substrate 61*a*, a plurality of passages are formed along the axial direction. At the wall surfaces of these exhaust passages, a catalyst carrier 50 on which the catalyst particles 51, 52 are carried is arranged. The upstream side substrate 61*a* is formed to be closely attached to the inside surface of the upstream side container 61*b*. That is, the exhaust which flows into the upstream side catalyst 61 all runs through the exhaust passages which are formed in the upstream side substrate 61*a*.

The upstream side catalyst 61 is connected to the exhaust pipe 12. At the inside of the upstream side container 61*b*, at the upstream side of the upstream side substrate 61*a*, a space 66 is formed for the inflowing exhaust to diffuse. The hydrocarbon feed valve 15 in the present embodiment is arranged near the upstream side catalyst 61.

The downstream side catalyst 62 includes a downstream side substrate 62*a* on which catalyst particles 55, 56 are carried and a downstream side container 62*b* which contains the downstream side substrate 62*a*. The downstream side substrate 62*a* in the present embodiment is formed into a honeycomb structure. The downstream side substrate 62*a* in the present embodiment is formed into a columnar shape. Inside of the downstream side substrate 62*a*, a plurality of passages are formed along the axial direction. At the wall surfaces of the passages of the exhaust, a catalyst carrier 54 on which catalyst particles 55, 56 are carried is arranged.

The downstream side container 62*b* in the present embodiment is formed into a tube. The cross-sectional area of the downstream side container 62*b* is formed larger than the cross-sectional area of the downstream side substrate 62*a*. The downstream side substrate 62*a* in the present embodiment contacts the bottom part of the downstream side container 62*b*. On the other hand, at the side and top of the downstream side substrate 62*a*, a clearance part 69 is formed between the outer circumference of the downstream side substrate 62*a* in the peripheral direction and the downstream side container 62*b*. This clearance part 69 forms a channel through which the exhaust flows. The downstream side substrate in the present embodiment contacts the bottom part of the downstream side container, but the invention is not limited to this. The downstream side substrate may also be separated from the bottom part of the downstream side container. That is, the lower part of the downstream side substrate may also be formed with a channel for the exhaust.

In the present embodiment, the area of the end face of the upstream side substrate 61*a* into which the exhaust flows is formed smaller than the area of the end face of the downstream side substrate 62*a* into which the exhaust flows. In the present embodiment, both of the upstream side substrate 61*a* and the downstream side substrate 62*a* are formed into columnar shapes. For this reason, in the present embodiment, the diameter of the upstream side substrate 61*a* is formed to become smaller than the diameter of the downstream side substrate 62*a*. The upstream side substrate 61*a* is formed to be smaller than the downstream side substrate 62*a*.

The upstream side container 61*b* of the upstream side catalyst 61 is directly connected to the downstream side container 62*b* of the downstream side catalyst 62. The upstream side container 61*b* is connected to the downstream side container 62*b* without going through piping. That is, the upstream side container 61*b* is joined to the downstream side container 62*b*. The upstream side container 61*b* is arranged to stick out from the peripheral direction surface of the downstream side container 62*b*. The upstream side substrate 61*a* is arranged so that the outflowing exhaust heads toward the outer surface of the downstream side substrate 62*a* in the peripheral direction. The exhaust which flows out from the upstream side substrate 61*a* strikes the surface of the downstream side substrate 62*a* in the peripheral direction. Further, in the present embodiment, the upstream side substrate 61*a* is arranged so that the axial line 61*c* is not vertical, but slants with respect to the axial line 62*c* of the downstream side substrate 62*a*. The upstream side substrate 61*a* is arranged so that the outflowing exhaust heads toward the end of the downstream side substrate 62*a* at the outlet side. At the upstream side of the downstream side substrate 62*a*, a space 65 is formed so that the exhaust which enters from a plurality of directions strike and are mixed with each other.

The downstream side catalyst 62 is connected to the particulate filter 14. The particulate filter 14 in the present embodiment includes a substrate 14*a* inside of which exhaust passages are formed and a container 14*b* which contains the substrate 14*a*. Referring to FIG. 22, a partition plate 63 is arranged between the downstream side catalyst 62 and the particulate filter 14. The partition plate 63 prevents exhaust from flowing into the particulate filter 14 from the clearance between the downstream side substrate 62*a* and the downstream side container 62*b*. The exhaust which flows into the downstream side container 62*b* all runs through the passages inside of the downstream side substrate 62*a*.

At the front side of the end face of the substrate 14*a* of the particulate filter 14 at the side into which the exhaust flows, a space 67 is formed for mixing the exhaust. In the present embodiment, a temperature sensor 23 for detecting the temperature of the downstream side catalyst 62 is arranged in the space 67.

The exhaust which is discharged from the engine body 1, as shown by the arrow 91, passes through the exhaust pipe 12 and flows into the exhaust purification catalyst 13. Fuel is injected from the hydrocarbon feed valve 15 whereby hydrocarbons are fed into the exhaust. The exhaust containing the hydrocarbons flows into the upstream side catalyst 61. The exhaust diffuses in the space 66 and flows into the upstream side substrate 61*a*. At the upstream side substrate 61*a*, the hydrocarbons are partially oxidized. The partially oxidized hydrocarbons flow out from the upstream side substrate 61*a* together with the exhaust.

The exhaust which flows out from the upstream side substrate 61*a* flows inside of the downstream side container 62*b*. In the exhaust purification catalyst 13 in the present embodiment, the exhaust which flows out from the upstream side catalyst 61 is divided inside of the downstream side container 62*b*. The divided exhaust flows toward a plurality of directions. In the present embodiment, the exhaust which flowed out from the upstream side substrate 61*a* strikes the surface of the downstream side substrate 62*a* in the peripheral direction. As a result, as shown by the arrows 93, 94, the flow of exhaust is divided into a plurality of directions along the surface of the downstream side substrate 62*a* in the peripheral direction. Further, part of the exhaust which strikes the surface of the downstream side substrate 62*a*, as shown by the arrow 92, proceeds toward the space 65. The divided exhaust, as shown by the arrows 93, 94, proceeds along the surface of the downstream side substrate 62*a*, then changes in orientation and heads toward the space 65.

At the space 65 which is formed at the upstream side of the end face of the downstream side substrate 62*a* at the inlet side, the exhaust which was divided into a plurality of directions again is merged. The exhaust which is merged at the space 65, as shown by the arrow 95, runs through the inside of the downstream side substrate 62*a* of the downstream side catalyst 62. Inside of the downstream side substrate 62*a*, reducing intermediates are formed. Further, they react with the active $NO_X$ whereby $NO_X$ is removed.

The exhaust which flowed out from the downstream side catalyst 62, as shown by the arrow 96, runs through the particulate filter 14. In the particulate filter 14, the particulate is trapped.

In the exhaust purification catalyst 13 of the present embodiment, the upstream side container 61*b* is directly connected to the downstream side container 62*b* without going through piping. For this reason, the exhaust purification catalyst 13 can be made smaller in size. Alternatively, when forming an exhaust purification system of a predetermined volume, it is possible to increase the volumes of the upstream side catalyst 61 and the downstream side catalyst 62. By enlarging the volumes of the respective substrates, the $NO_X$ removal rates can be improved. Further, the upstream side catalyst 61 and the downstream side catalyst 62 are not connected through piping with small flow sectional areas, so a rise in back pressure can be suppressed.

The upstream side container 61*b* in the present embodiment is formed so as to stick out at the surface of the downstream side container 62*b* in the peripheral direction. The exhaust which flows out from the upstream side catalyst 61 strikes the surface of the downstream side substrate 62*a* of the downstream side catalyst in the peripheral direction and is divided into a plurality of directions. In the exhaust purification system of the present embodiment, the exhaust is divided toward a plurality of directions at the inside of the downstream side container 62*b* of the downstream side catalyst 62, pass through the channels between the downstream side substrate 62*a* and the downstream side container 62*b*, then merge. The merged exhaust flows into the downstream side substrate 62*a*. After the exhaust is once divided, when merging in the space 65, the exhaust which flows in from the plurality of directions strike each other whereby they are sufficiently mixed and agitated. That is, it is possible to mix the exhaust and reduce the unevenness of the concentration of hydrocarbons which are contained in the exhaust. The uniformity of concentration of hydrocarbons of the exhaust which flows into the downstream side substrate can be improved. Further, after dividing the exhaust, it is again made to merge in the space 65, so the channel through which the exhaust runs can be lengthened. The exhaust is mixed while traveling through the channel whereby the uniformity of concentration of hydrocarbons can be improved. As a result, it is possible to suppress deterioration of the $NO_X$ removal rate due to unevenness of the concentration of hydrocarbons which flow into the downstream side substrate 62*a*.

Further, in the present embodiment, the upstream side catalyst 61 is arranged at the upstream side of the downstream side catalyst 62 which reduces the $NO_X$. By injecting fuel into the exhaust which runs through the exhaust pipe 12, the exhaust contains hydrocarbons. When the exhaust runs through the inside of the exhaust pipe 12, a velocity distribution of the exhaust occurs. For this reason, inside of the exhaust pipe 12, unevenness easily arises in the concentration of the hydrocarbons. However, by running the exhaust through the passages at the inside of the upstream side substrate 61*a*, the velocity distribution can be made uniform. For example, at the inside of the exhaust pipe, the velocity is large at the center in cross-section. The velocity becomes smaller the further toward the wall surfaces. However, the passages at the inside of the upstream side substrate 61*a* are narrow, so when the exhaust passes through the upstream side substrate 61*a*, there is less fluctuation in the velocity in the radial direction. For this reason, it is possible to reduce the unevenness of concentration of hydrocarbons which are contained in the exhaust which is fed to the downstream side catalyst 62.

Further, in the exhaust purification catalyst 13 in the present embodiment, the exhaust which flows out from the upstream side substrate 61*a* is released to the inside of the downstream side container 62*b* without going through any piping. For this reason, it is possible to reduce the unevenness of concentration of hydrocarbons which occurs due to passage through piping.

Furthermore, in the present embodiment, the upstream side catalyst 61 performs partial oxidation of the hydrocarbons. Due to the hydrocarbons which are contained in the exhaust being reformed, the viscosity of the exhaust becomes smaller and mixing becomes easier. In the present embodiment, inside of the downstream side container 62*b*, exhaust made smaller in viscosity is mixed and agitated, so it is possible to efficiently reduce the unevenness of concentration of hydrocarbons. It is possible to feed exhaust made uniform in concentration of hydrocarbons to the downstream side substrate 62*a*.

In this way, the exhaust purification system in the present embodiment can increase the uniformity of the concentration of hydrocarbons which are contained in exhaust which flows into the downstream side substrate 62*a* even without arranging a member which disperses the exhaust or a member which agitates the exhaust. For example, in the first $NO_X$ removal method, it is possible to reform the hydrocarbons and remove the $NO_X$ at the downstream side catalyst 62 without providing an upstream side catalyst 61. That is, it is possible to remove the $NO_X$ by a single catalyst which is formed by catalyst particles of precious metals and a basic layer. In this case, it is possible to partially oxidize the hydrocarbons and produce radicals inside of the single catalyst. In this regard, when exhaust which flows through the exhaust pipe flows into the single catalyst, sometimes the concentration of hydrocarbons which are contained in the exhaust becomes uneven. For this reason, sometimes the $NO_X$ removal rate of the single catalyst falls.

As opposed to this, in the exhaust purification system of the present embodiment, by arranging the upstream side catalyst which has an oxidation function in addition to the downstream side catalyst which reduces the $NO_X$, it is possible to effectively feed reformed hydrocarbons to the downstream side catalyst and suppress unevenness of concentration of the reformed hydrocarbons. The exhaust purification system of the present embodiment can feed a uniform concentration of hydrocarbons to all channels of the downstream side substrate. As a result, it is possible to improve the $NO_X$ removal rate.

Referring to FIG. 22, in the present embodiment, the upstream side substrate 61*a* has an axial line 61*c* which is not vertical to, but is slanted from, the axial line 62*c* of the downstream side substrate 62*a*. The exhaust which flows out from the upstream side substrate 61*a* heads toward the end part of the downstream side substrate 62*a* at the outlet side. By employing this configuration, the exhaust which flows out from the upstream side substrate 61*a* can be fed toward the side of the downstream side substrate 62*a* opposite to the inlet side. It is possible to lengthen the path by which the exhaust which flows out from the upstream side substrate 61*a* flows into the downstream side substrate 62*a*. As a result, the agitation of the exhaust can be promoted and the concentration of the hydrocarbons of the exhaust can be made uniform.

In this regard, if increasing the length of the channel of the exhaust, the problem arises of the fuel depositing on the wall surfaces of the exhaust passage. Due to the hydrocarbons which were fed from the hydrocarbon feed valve depositing on the wall surfaces of the engine exhaust passage, the peak of concentration of hydrocarbons becomes blunted. For example, the maximum value of the concentration of hydrocarbons becomes smaller. The concentration of hydrocarbons which flow into the upstream side catalyst and the downstream side catalyst is preferably controlled to the desired range of concentration. However, due to the hydrocarbons depositing on the wall surfaces, the maximum value of the concentration of hydrocarbons becomes smaller and sometimes the desired range of concentration of hydrocarbons is deviated from. As a result, sometimes the removal rate of $NO_X$ falls.

In the exhaust purification system of the present embodiment, a clearance part 69 is formed as a passage for exhaust between the downstream side substrate 62*a* and the downstream side container 62*b*. In the present embodiment, a channel for exhaust is formed between the outer surface of the downstream side substrate 62*a* in the peripheral direction and the inside surface of the downstream side container 62*b*. During the time period of normal operation, the downstream side substrate 62*a* generates heat. For this reason, it is possible to suppress a drop in temperature of the exhaust and possible to keep hydrocarbons from depositing on the surface of the downstream side substrate 62*a* or the inner surface of the downstream side container 62*b* even if increasing the length of the channel for the exhaust.

In particular, in the first $NO_X$ removal method of the present embodiment, the interval for feed of hydrocarbons is short, so during the time period of normal operation, the temperature of the downstream side substrate 62*a* becomes higher than the temperature of the exhaust. For this reason, even if the exhaust is made to strike the surface of the downstream side substrate 62*a* in the peripheral direction, the exhaust will strike high temperature parts, so deposition of hydrocarbons can be suppressed. As a result, it is possible to maintain the peak of concentration of hydrocarbons at a desired magnitude and possible to efficiently remove $NO_X$.

Further, the exhaust purification system in the present embodiment is formed so that the area of the end face of the upstream side substrate 61*a* into which the exhaust flows is smaller than the area of the end face of the downstream side substrate 62*a* into which the exhaust flows. By making the area of the end face of the upstream side substrate 61*a* at the inlet side smaller in this way, it is possible to suppress unevenness of concentration of hydrocarbons which are contained in the exhaust which flows into the upstream side substrate 61*a*. If the area of the end face of the upstream side substrate 61*a* at the inlet side is large, the hydrocarbons will not sufficiently diffuse in the radial direction of the upstream side substrate 61*a* and the concentration of hydrocarbons which are contained in the exhaust will end up becoming uneven. In the upstream side catalyst 61, by reducing the area of the end face of the upstream side substrate 61*a* at the inlet side, it is possible to reduce the unevenness of concentration of hydrocarbons in the exhaust which flows into the upstream side substrate 61*a*.

Furthermore, in the first $NO_X$ removal method of the present embodiment, it is necessary to not just cause the hydrocarbons which are fed to the exhaust to vaporize, but to reform them at the upstream side catalyst 61. To efficiently cause the hydrocarbons to partially oxidize at the upstream side catalyst 61, for example, it is preferable to raise the concentration of hydrocarbons which flow into the upstream side catalyst 61. In this case, it is preferable to reduce the flow sectional area of the upstream side catalyst. In this regard, when the exhaust purification catalyst is comprised of a single catalyst which has catalyst particles of precious metals and a basic layer, if reducing the flow sectional area of the substrate, it is necessary to lengthen the substrate. As a result, the back pressure rises and the temperature loss becomes larger. By arranging an upstream side catalyst of the volume which is required for making the hydrocarbons partially oxidize at the upstream side like in the present embodiment, it is possible to shorten the part with a small flow sectional area and possible to suppress the rise in back pressure or temperature loss while efficiently removing $NO_X$.

The exhaust purification system is formed so that exhaust which flows out from the upstream side catalyst strikes the surface of the downstream side substrate of the downstream side catalyst in the peripheral direction, but the invention is not limited to this. The exhaust purification system may also be formed so that the exhaust which flows out from the upstream side catalyst is divided at the inside of the downstream side container into a plurality of directions, runs through the channel between the downstream side substrate and the downstream side container, then merges.

Figure 24:
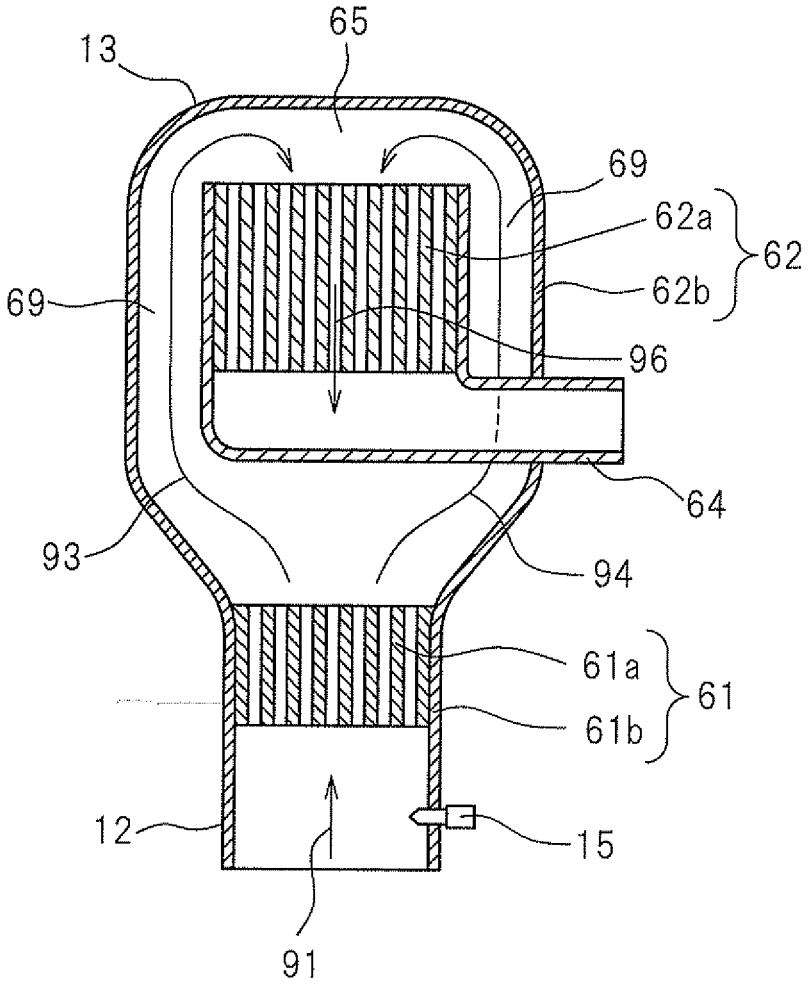
FIG. 24 is a schematic cross-sectional view of another exhaust purification system in an embodiment.

FIG. 24 shows a schematic cross-sectional view of another exhaust purification system in the present embodiment. The other exhaust purification system is provided with an exhaust purification catalyst 13 for removal of $NO_X$. The exhaust purification catalyst 13 includes an upstream side catalyst 61 and a downstream side catalyst 62. The exhaust purification catalyst 13 of the other exhaust purification system is formed so that the axial direction of the upstream side substrate 61*a* and the axial direction of the downstream side substrate 61*b* become substantially parallel.

The upstream side catalyst 61 is connected to the exhaust pipe 12. The upstream side container 61*b* is directly connected to the downstream side container 62*b* without going through piping. The other exhaust purification system as well can also be made smaller in size.

The downstream side substrate 62*a* of the downstream side catalyst 62 is arranged so that the end face at the inlet side faces the side opposite to the side facing the upstream side substrate 61*a*. The outlet of the downstream side substrate 62*a* is connected to an exhaust pipe 64. The exhaust pipe 64 is formed so as to cover the end face of the downstream side substrate 62*a* at the outlet side. All of the exhaust which flows out from the downstream side substrate 62*a* flows into the exhaust pipe 64. The exhaust purification catalyst 13 is formed so that the end face of the upstream side substrate 61*a* at the outlet side faces the exhaust pipe 12. Between the downstream side substrate 62*a* and the downstream side container 62*b*, a clearance part 69 is formed. The clearance part 69 functions as a channel through which the exhaust runs.

In the other exhaust purification system of the present embodiment, the exhaust which flows out from the upstream side catalyst 61 strikes the outer surface of the exhaust pipe 64. The exhaust, as shown by the arrows 93, 94, is divided into a plurality of directions. The exhaust runs through the channel between the downstream side substrate 62*a* and the downstream side container 62*b* and flows into a space 65. In the space 65, the exhaust which was divided into the plurality of directions is again merged. The exhaust, as shown by the arrow 96, passes through the downstream side substrate 62*a* and is exhausted to the exhaust pipe 64.

In the other exhaust purification system as well, by dividing, then re-merging the exhaust, it is possible to mix and agitate the exhaust. Further, it is possible to lengthen the path of the exhaust. For this reason, it is possible to feed exhaust made uniform in concentration of hydrocarbons to the downstream side substrate 62*a*.

In another exhaust purification system, the exhaust which flows out from the upstream side substrate 61*a* strikes the outer surface of the exhaust pipe 64. During the time period of normal operation, the downstream side catalyst 62 generates heat, so the exhaust which flows out from the downstream side substrate 62*a* becomes high in temperature. For this reason, the exhaust pipe 64 which is connected to the downstream side substrate 62*a* rises in temperature and hydrocarbons can be kept from depositing on the outer surface of the exhaust pipe 64. In this way, even in the other exhaust purification system of the present embodiment, the $NO_X$ removal rate can be improved.

The upstream side catalyst in the present embodiment has the configuration of a so-called three-way catalyst for partially oxidizing hydrocarbons, but the invention is not limited to this. The upstream side catalyst need only have the function of oxidizing hydrocarbons. For example, the upstream side catalyst may have a configuration similar to the downstream side catalyst in the present embodiment. That is, the upstream side catalyst may also have a basic layer which is formed around the catalyst particles in addition to the catalyst particles of the precious metals.

In this case, it is possible to produce reducing intermediates in the upstream side catalyst. That is, when the concentration of hydrocarbons of the exhaust which flows into the upstream side catalyst is low, the $NO_X$ is activated to produce active $NO_X$. The produced active $NO_X$ is held on the surface of the basic layer. If the concentration of hydrocarbons of the exhaust becomes high, the hydrocarbons are partially oxidized to produce radicals of hydrocarbons. The active $NO_X$ and the partially oxidized hydrocarbons react whereby the reducing intermediates are produced. The reducing intermediates which are produced in the upstream side catalyst as well can be used to reduce and remove the $NO_X$. Alternatively, the reducing intermediates which are produced in the upstream side catalyst can be fed to the downstream side catalyst.

Even when configuring the upstream side catalyst in the same way as the downstream side catalyst in the present embodiment, it is possible to perform the second $NO_X$ removal method in the present embodiment. That is, by making the feed interval of fuel from the hydrocarbon feed valve longer, the upstream side catalyst functions as an $NO_X$ storage catalyst. By making the upstream side catalyst and the downstream side catalyst function as $NO_X$ storage catalysts, it is possible to increase the capacity when performing the second $NO_X$ removal control.

The upstream side substrate of the upstream side catalyst and the downstream side substrate of the downstream side catalyst in the present embodiment are formed into columnar shapes, but the invention is not limited to this. Any shapes can be employed.

In the present embodiment, a hydrocarbon feed valve is arranged in the engine exhaust passage and hydrocarbons are fed from the hydrocarbon feed valve to thereby feed hydrocarbons to the exhaust purification catalyst, but the invention is not limited to this. Any device or control can be used to feed hydrocarbons to the exhaust purification catalyst.

The above embodiments may be suitably combined. In the above figures, the same or equivalent parts are assigned the same reference notations. Note that the above embodiments are illustrative and do not limit the invention. Further, the embodiments include changes which are shown in the claims.

REFERENCE SIGNS LIST

2 combustion chamber
3 fuel injector
13 exhaust purification catalyst
15 hydrocarbon feed valve
50 catalyst carrier
51, 52 catalyst particles
54 catalyst carrier
55, 56 catalyst particles
57 basic layer
58 exhaust flow surface parts
61 upstream side catalyst
61*a* upstream side substrate
61*b* upstream side container
61*c* axial line
62 downstream side catalyst
62*a* downstream side substrate
62*b* downstream side container
62*c* axial line
65 space
69 clearance part

The invention claimed is:

1. An exhaust purification system of an internal combustion engine comprising:

an engine exhaust passage;

an exhaust purification catalyst for causing $NO_x$ that is contained in exhaust and hydrocarbons to react inside the engine exhaust passage, wherein the exhaust purification catalyst comprises an upstream side catalyst and a downstream side catalyst that are connected in series in the engine exhaust passage, wherein the upstream side catalyst has an oxidizing ability, and the downstream side catalyst carries catalyst particles of precious metals on an exhaust flow surface and forms basic exhaust flow surface parts around the catalyst particles; and an electronic control unit, wherein the electronic control unit is configured to control a vibration of a concentration of hydrocarbons flowing into the exhaust purification catalyst within a predetermined range of amplitude and within a predetermined range of period, and is configured to control the vibration period of the hydrocarbon concentration longer than the predetermined range of period, wherein when the electronic control unit controls the vibration of the concentration of hydrocarbons flowing into the exhaust purification catalyst within the predetermined range of amplitude and within the predetermined range of period, the exhaust purification catalyst has a property of chemically reducing the $NO_x$ that is contained in exhaust without storing, or storing a fine amount of nitrates in the basic exhaust flow surface parts, and produces a reducing intermediate containing nitrogen and hydrocarbons that chemically reduces the $NO_x$ contained in the exhaust by a reducing action of the produced reducing intermediate when the electronic control unit controls the vibration period of the concentration of hydrocarbons longer than the predetermined range of period, the exhaust purification catalyst has a property of increasing a storage amount of $NO_x$ that is contained in exhaust, the upstream side catalyst comprises an upstream side substrate at which catalyst particles are carried and an upstream side container that contains the upstream side substrate, partially oxidizes the hydrocarbons that are contained in the exhaust, and feeds the partially oxidized hydrocarbons to the downstream side catalyst, the downstream side catalyst comprises a downstream side substrate at which catalyst particles are carried, a downstream side container that contains the downstream side substrate, and a channel of exhaust which is formed by a clearance part between the downstream side substrate and the downstream side container, the upstream side container is connected to the downstream side container, the exhaust that flows out from the upstream side substrate and contains partially oxidized hydrocarbons is divided toward a plurality of directions at the inside of the downstream side container, and the divided exhaust runs through the channel between the downstream side substrate and the downstream side container, then merges to be mixed, and the mixed exhaust flows into the downstream side substrate.

2. The exhaust purification system of an internal combustion engine as set forth in claim 1, wherein an area of an end face of the upstream side substrate into which the exhaust flows is formed smaller than an area of an end face of the downstream side substrate into which the exhaust flows.

3. The exhaust purification system of an internal combustion engine as set forth in claim 1, wherein the upstream side container is connected to a surface of the downstream side container in the peripheral direction, the upstream side substrate is arranged so that the exhaust that flows out from the upstream side substrate heads toward an outer surface of the downstream side substrate in the peripheral direction, and the exhaust that flows out from the upstream side substrate is divided into a plurality of directions at the outer surface of the downstream side substrate in the peripheral direction.

4. The exhaust purification system of an internal combustion engine as set forth in claim 1, wherein the upstream side catalyst has catalyst particles of precious metals, partially oxidizes the hydrocarbons that are contained in exhaust, and feeds the partially oxidized hydrocarbons to the downstream side catalyst.

5. The exhaust purification system of an internal combustion engine as set forth in claim 1, wherein the upstream side substrate has an axial line that extends along the passage of the exhaust, the downstream side substrate has an axial line that extends along the passage of the exhaust, and the upstream side substrate is arranged so that the axial line of the upstream side substrate is slanted with respect to the axial line of the downstream side substrate so that the exhaust that flows out from the upstream side substrate heads toward the end of the downstream side substrate at the outlet side.

6. The exhaust purification system of an internal combustion engine as set forth in claim 5, wherein an area of an end face of the upstream side substrate into which the exhaust flows is formed smaller than an area of an end face of the downstream side substrate into which the exhaust flows.

7. The exhaust purification system of an internal combustion engine as set forth in claim 5, wherein the upstream side container is connected to a surface of the downstream side container in the peripheral direction, the upstream side substrate is arranged so that the exhaust which flows out from the upstream side substrate heads toward an outer surface of the downstream side substrate in the peripheral direction, and the exhaust that flows out from the upstream side substrate is divided into a plurality of directions at the outer surface of the downstream side substrate in the peripheral direction.

8. The exhaust purification system of an internal combustion engine as set forth in claim 5, wherein the upstream side catalyst has catalyst particles of precious metals, partially oxidizes the hydrocarbons that are contained in exhaust, and feeds the partially oxidized hydrocarbons to the downstream side catalyst.

* * * * *